US009134690B2

(12) United States Patent
Kato et al.

(10) Patent No.: US 9,134,690 B2
(45) Date of Patent: Sep. 15, 2015

(54) IMAGE FORMING APPARATUS CAPABLE OF RELIABLY PROTECTING EXPOSURE MEMBER

(71) Applicants: Atsushi Kato, Ichinomiya (JP); Toshio Furukawa, Nagoya (JP)

(72) Inventors: Atsushi Kato, Ichinomiya (JP); Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/168,042

(22) Filed: Jan. 30, 2014

(65) Prior Publication Data

US 2014/0212170 A1 Jul. 31, 2014

(30) Foreign Application Priority Data

Jan. 30, 2013 (JP) ..... 2013-015318

(51) Int. Cl.
*G03G 15/00* (2006.01)
*G03G 21/16* (2006.01)
*G03G 21/18* (2006.01)

(52) U.S. Cl.
CPC ..... *G03G 21/1666* (2013.01); *G03G 21/1832* (2013.01); *G03G 2221/1636* (2013.01)

(58) Field of Classification Search
CPC ..... G03G 15/011; G03G 15/04054; G03G 21/1666; G03G 21/1807; G03G 21/1832; G03G 2215/0407; G03G 2215/0409; G03G 2221/1603; G03G 2221/1636
USPC ..... 399/111, 112, 114, 118; 347/117, 118, 347/138, 242, 245, 257, 263
See application file for complete search history.

(56) References Cited

U.S. PATENT DOCUMENTS

| | | | | |
|---|---|---|---|---|
| 5,157,416 | A * | 10/1992 | Kinoshita et al. | 347/263 |
| 6,308,024 | B1 * | 10/2001 | Nakayama et al. | 399/98 |
| 7,388,593 | B2 * | 6/2008 | Fukuda | 347/138 |
| 8,583,004 | B2 * | 11/2013 | Kamimura | 399/110 |
| 8,688,000 | B2 * | 4/2014 | Sato et al. | 399/110 |
| 8,712,281 | B2 * | 4/2014 | Nakano et al. | 399/110 |
| 2008/0286001 | A1 * | 11/2008 | Matsumoto et al. | 399/112 |
| 2012/0207510 | A1 | 8/2012 | Sato | |
| 2012/0237255 | A1 | 9/2012 | Souda | |
| 2012/0328325 | A1 | 12/2012 | Sato | |
| 2013/0308983 | A1 * | 1/2013 | Takano | 399/205 |

FOREIGN PATENT DOCUMENTS

| | | | |
|---|---|---|---|
| JP | 2001175046 | A * | 6/2001 |
| JP | 2005140944 | A * | 6/2005 |
| JP | 2012063378 | A * | 3/2012 |
| JP | 2012-168271 | A | 9/2012 |
| JP | 2012-168272 | A | 9/2012 |
| JP | 2012-194396 | A | 10/2012 |
| JP | 2013-007948 | A | 1/2013 |

* cited by examiner

*Primary Examiner* — Robert Beatty
(74) *Attorney, Agent, or Firm* — Banner & Witcoff, Ltd.

(57) ABSTRACT

An image forming apparatus includes: a main casing; a photosensitive member; a moving mechanism; a movable member; and a cartridge. The photosensitive member is provided in the main casing. The movable member moves between an inside position in which the movable member is inside the main casing and an outside position in which the movable member is at least partly outside the main casing. The movable member includes: a frame; a protection member; and an exposure member. The protection member is fixed to the frame. The moving mechanism moves the exposure member between an exposing position in which the exposure member exposes the photosensitive member to light and a protected position in which the exposure member is protected by the protection member. The cartridge includes a developer bearing member. The cartridge is supported at the movable member.

16 Claims, 10 Drawing Sheets

TOP
REAR
FRONT
BOTTOM 36
74
76
75
77
35

93
88
89
90
95
97
94
96
92
82(80)

105
104
103
100
101
106
83(80)

109
110
112
111
84(80)

116
118
118
118
118
115
117
85(80)

IMAGE FORMING APPARATUS CAPABLE OF RELIABLY PROTECTING EXPOSURE MEMBER

CROSS REFERENCE TO RELATED APPLICATION

This application claims priority from Japanese Patent Application No. 2013-015318 filed Jan. 30, 2013. The entire content of the priority application is incorporated herein by reference.

TECHNICAL FIELD

The present invention relates to an image forming apparatus using an electrophotographic method.

BACKGROUND

There is known, as an image forming apparatus, a printer provided with a plurality of photosensitive drums and a plurality of exposure members for exposing the corresponding photosensitive drums.

There is proposed, as such a printer, one detachably provided with a drum drawer having a plurality of photosensitive drums; and a developing drawer having a plurality of developing units and a plurality of LED units.

In the printer of such a type, when the drum drawer and the developing drawer are detached from the printer, first the developing drawer is moved in a direction away from the dram drawer, i.e., in such a direction that an LED array of the LED unit is away from the photosensitive drum, and withdrawn, and then the drum drawer is withdrawn.

Further, as such a printer, there is also proposed one provided with a process unit having a plurality of LED units; a plurality of drum units pivotally movably mounted with respect to the process unit; and a plurality of developing cartridges detachably attached to the process unit.

In the printer of such a type, when the developing cartridge is detached from the process unit, the drum unit is pivotally moved in association with the detaching operation to separate a photosensitive drum from an LED array of the LED unit and to cover the LED array with an LED cover.

SUMMARY

In the former printer, when the developing drawer is detached, the LED array is separated away from the photosensitive drum and then the developing drawer is withdrawn. Hence, sliding friction of the LED array with respect to the photosensitive drum and contact thereof with other members can be prevented. However, the LED array is exposed after the developing drawer is withdrawn, so that a user may accidentally touch the LED array to damage or soil the same.

Further, in the latter printer, by covering the LED array with the LED cover when separating the photosensitive drum away from the LED array, the LED array can be protected. However, the LED cover covers the LED array through the pivotal movement thereof, so that a mechanical strength thereof is insufficient. Thus, if the developing cartridge interferes with the LED cover when being attached to the process unit, the LED array may be damaged through the LED cover.

In view of the foregoing, it is an object of the present invention to provide an image forming apparatus capable of reliably protecting an exposure member and ensuring reliability of the image forming apparatus over a prolonged period of time.

In order to attain the above and other objects, the present invention provides an image forming apparatus including: a main casing; a photosensitive member; a moving mechanism; a movable member; and a cartridge. The photosensitive member is provided in the main casing. The movable member is configured to move between an inside position in which the movable member is inside the main casing and an outside position in which the movable member is at least partly outside the main casing. The movable member includes: a frame; a protection member; and an exposure member. The protection member is fixed to the frame. The exposure member is configured to expose the photosensitive member to light. The moving mechanism is configured to move the exposure member between an exposing position in which the exposure member exposes the photosensitive drum to light and a protected position in which the exposure member is protected by the protection member. The cartridge includes a developer bearing member. The cartridge is configured to be supported at the movable member.

According to another aspect, the present invention provides an image forming apparatus including: a main casing; a cartridge; a moving mechanism; and a movable member. The cartridge includes a photosensitive member and a developer bearing member. The movable member is configured to move between an inside position in which the movable member is inside the main casing and an outside position in which the movable member is at least partly outside the main casing. The cartridge is configured to be supported at the movable member. The movable member includes: a frame; a protection member; and an exposure member. The protection member is fixed to the frame. The exposure member is configured to expose the photosensitive member to light. The moving mechanism is configured to move the exposure member between an exposing position in which the exposure member exposes the photosensitive drum to light and a protected position in which the exposure member is protected by the protection member.

BRIEF DESCRIPTION OF THE DRAWINGS

In the drawings;

FIGS. 6A to 6E are detailed views of the LED unit and members constituting a link mechanism, in which FIG. 6A illustrates the LED unit, FIG. 6B illustrates a pivot plate of the link mechanism, FIG. 6C illustrates an interlocking plate of the link mechanism, FIG. 6D illustrates a base plate of the link mechanism, and FIG. 6E illustrates a translation cam of the link mechanism;

FIGS. 8A and 8B are enlarged explanatory views for explaining interlocking motion of the LED unit of FIG. 7, in which FIG. 8A illustrates a state where the LED unit is disposed at a retracted position, and FIG. 8B illustrates a state where the LED unit is disposed at a protected position.

DETAILED DESCRIPTION

1. Overall Structure of Printer

Next, an overall structure of a printer as an image forming apparatus according to a first embodiment of the present invention will be described with reference to FIGS. 1 through 6E.

Figure 1:
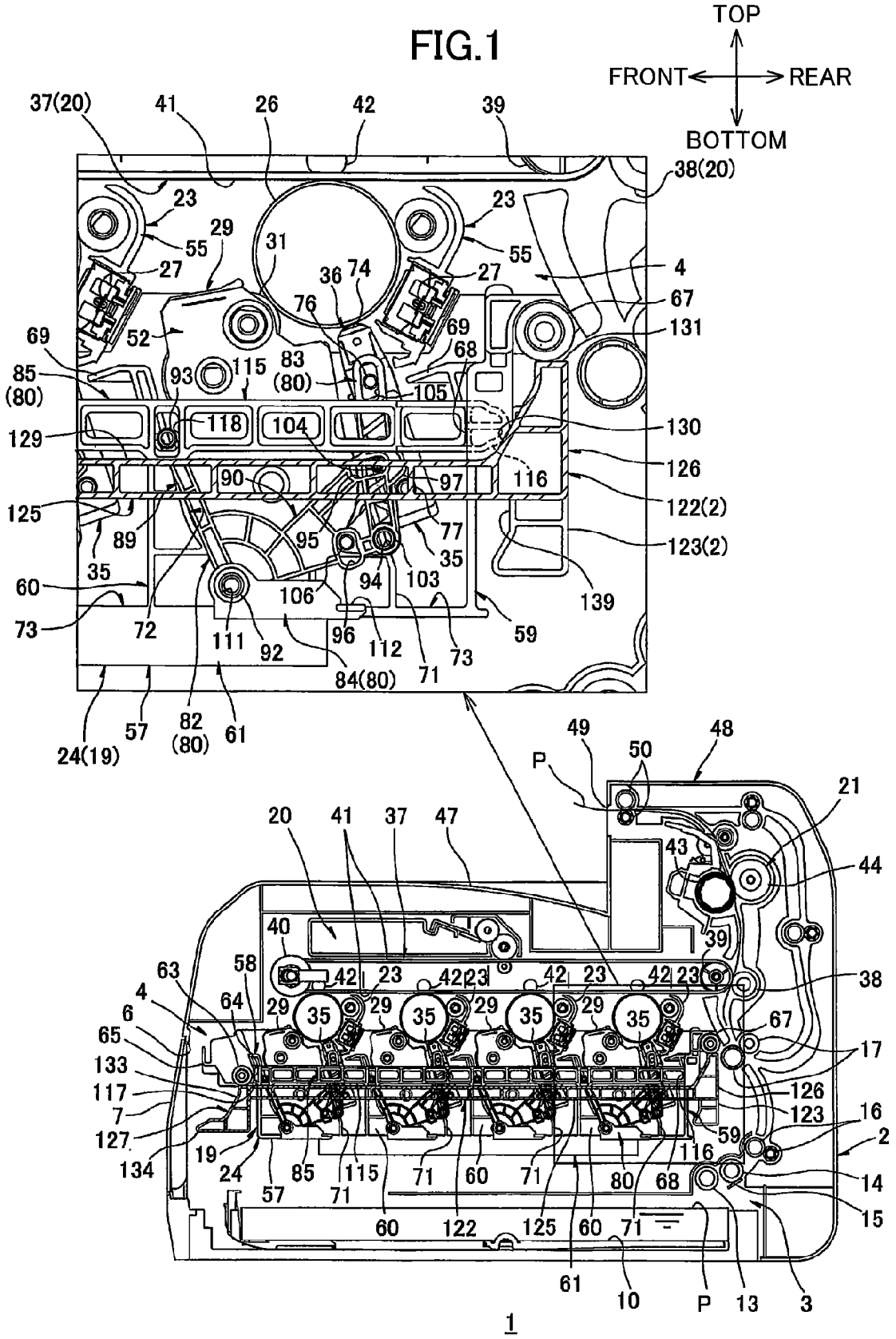
FIG. 1 is a center cross-sectional view of a printer as an image forming apparatus according to a first embodiment of the present invention, and an enlarged view of an essential portion of the printer, in which LED units are disposed at an exposing position and a developing drawer frame is disposed at an inside position.

As illustrated in FIG. 1, the printer 1 is a horizontal tandem-type intermediate transfer color printer. The printer 1 includes a main casing 2, and, within the main casing 2, a sheet supply unit 3 for supplying a sheet P, and an image forming unit 4 for forming an image on the sheet P supplied from the sheet supply unit 3.

In the following description, the terms "upward", "downward", "upper", "lower", "above", "below", "beneath", "right", "left", "front", "rear" and the like will be used assuming that the printer 1 is disposed in an orientation in which it is intended to be used. That is, directions used in the following description in relation to the printer 1 will reference the state of the printer 1 when the printer 1 is resting on a flat surface.

More specifically, as indicated by the direction arrows in FIG. 1, a top side and a bottom side in FIG. 1 will be referred to as a top side and a bottom side, respectively; a left side and a right side in FIG. 1 will be referred to as a front side and a rear side, respectively. Further, left and right sides of the printer 1 will be based on the perspective of a user facing the front side of the printer 1. Thus, a near side and a far side in FIG. 1 will be referred to as a right side and a left side, respectively.

(1) Main Casing

The main casing 2 is formed in a box-like shape that is generally rectangular in a side view, for accommodating the sheet supply unit 3 and the image forming unit 4 therein. The main casing 2 has a front wall in which an opening 6 is formed. A front cover 7 is provided on a front end portion of the main casing 2. The front cover 7 is pivotally movable about its lower end portion between a closed position illustrated in FIG. 1 for covering the opening 6, and an open position illustrated in FIGS. 2 through 5 for exposing the opening 6.

(2) Sheet Supply Unit

As illustrated in FIG. 1, the sheet supply unit 3 includes a sheet supply tray 10 accommodating the sheets P therein. The sheets P on the sheet supply tray 10 are fed, by rotation of a pickup roller 13, to a position between a sheet supply roller 14 and a sheet supply pad 15. Rotation of the sheet supply roller 14 separates and feeds the sheets P one at a time. As the sheet supply roller 14 continues to rotate, each separated sheet P subsequently passes between a pair of pinch rollers 16, and is supplied toward a pair of registration rollers 17 disposed above the pinch rollers 16. By rotation of the registration rollers 17, the sheet P is conveyed to the image forming unit 4, more specifically, to a position between an intermediate transfer belt 41 (described later) and a secondary transfer roller 38 (described later), at a predetermined timing.

(3) Image Forming Unit

The image forming unit 4 is disposed above the sheet supply unit 3, and includes a process unit 19, a transfer unit 20, and a fixing unit 21.

(3-1) Process Unit

The process unit 19 is disposed at substantially a vertical center region of the main casing 2. The process unit 19 includes a plurality of (four in the embodiment) drum units 23 corresponding to four colors used in image formation, and a developing drawer 24.

The plurality of drum units 23 are disposed at an upper portion of the process unit 19, and arranged juxtaposed with and spaced apart from each other in a front-rear direction. Each of the drum units 23 integrally supports a photosensitive drum 26 and a scorotron charger 27.

The photosensitive drum 26 is formed in a substantially cylindrical shape that is elongated in a left-right direction.

The scorotron charger 27 is disposed opposite to and spaced apart from the corresponding photosensitive drum 26 at a lower-rear side thereof.

The developing drawer 24 includes a plurality of (four in the embodiment) developing units 29 and a plurality of (four in the embodiment) LED units 35.

Each developing unit 29 is disposed at a lower-front side of the corresponding photosensitive drum 26. Toner is stored inside the developing unit 29. The developing unit 29 includes a developing roller 31.

The developing roller 31 is rotatably supported at an upper end portion of the developing unit 29 so as to be exposed from an upper-rear side of the developing unit 29. The developing roller 31 is in contact with the corresponding photosensitive drum 26 from the lower-front side thereof.

The developing unit 29 includes a toner supply roller (not illustrated) for supplying toner to the developing roller 31 and a layer thickness regulating blade (not illustrated) for regulating a thickness of the toner supplied to the developing roller 31.

Each LED unit 35 is disposed at a rear side of the corresponding developing unit 29 so as to be opposed to the corresponding photosensitive drum 26 from the lower-rear side thereof. The LED unit 35 includes an LED array 36. The LED array 36 has a plurality of LEDs arrayed in the left-right direction. The LED unit 35 exposes a surface of the corresponding photosensitive drum 26 to light based on predetermined image data.

(3-3) Transfer Unit

The transfer unit 20 is disposed above the drum units 23 at an upper portion of the main casing 2. The transfer unit 20 includes a belt unit 37 and the secondary transfer roller 38.

The belt unit 37 is disposed along the front-rear direction so as to be opposed to upper portions of the photosensitive drums 26 of the respective drum units 23 arranged juxtaposed with each other in the front-rear direction. The belt unit 37 includes a driving roller 39, a driven roller 40, the intermediate transfer belt 41, and a plurality of (four in the embodiment) primary transfer rollers 42.

The driving roller 39 and the driven roller 40 are disposed opposite to and spaced apart from each other in the front-rear direction.

The intermediate transfer belt 41 is looped around the driving roller 39 and the driven roller 40 in such a manner that a lower portion of the intermediate transfer belt 41 is in contact with the top sides of the photosensitive drums 26. When the driving roller 39 is driven to rotate, the intermediate transfer belt 41 circulates so that its lower portion contacting the photosensitive drums 26 moves from a front side to a rear side, and the driven roller 40 rotates along with the circulating movement of the intermediate transfer belt 41.

Each primary transfer roller 42 is provided so as to be opposed to the corresponding photosensitive drum 26, with the lower portion of the intermediate transfer belt 41 interposed between the bottom of the primary transfer roller 42 and the top of the corresponding photosensitive drum 26.

The secondary transfer roller 38 is provided at a rear side of the belt unit 37 so as to be opposed to the driving roller 39 of the belt unit 37 with the intermediate transfer belt 41 interposed therebetween.

(3-4) Fixing Unit

The fixing unit 21 is disposed above the secondary transfer roller 38, and includes a heating roller 43 and a pressure roller 44 opposite to the heating roller 43.

(4) Image Forming Operation

The toner stored in the developing unit 29 is supplied to the toner supply roller (not illustrated) and is then supplied to the developing roller 31.

The toner supplied to the developing roller 31 is positively tribo-charged between the toner supply roller (not illustrated) and the developing roller 31 in association with rotation of the developing roller 31. The layer thickness regulating blade (not illustrated) regulates the thickness of the toner supplied to the developing roller 31 as the developing roller 31 rotates, maintaining the toner carried on a surface of the developing roller 31 at a thin uniform thickness.

In the meantime, the scorotron charger 27 uniformly applies a positive charge to a surface of the photosensitive drum 26 as the photosensitive drum 26 rotates. Subsequently, the surface of the photosensitive drum 26 is exposed to light emitted from the corresponding LED unit 35 based on predetermined image data, forming an electrostatic latent image on the surface of the photosensitive drum 26 based on the image data. The toner carried on the developing roller 31 is then supplied to the electrostatic latent image formed on the surface of the photosensitive drum 26, to form a toner image on the surface of the photosensitive drum 26.

The toner image carried on the surface of each photosensitive drum 26 is sequentially primary-transferred onto the lower portion of the intermediate transfer belt 41 moving from the front side to the rear side. As a result, a color image is formed on the intermediate transfer belt 41.

The color image formed on the intermediate transfer belt 41 is secondary-transferred onto the sheet P supplied from the sheet supply unit 3 while the intermediate transfer belt 41 passes between the secondary transfer roller 38 and the driving roller 39.

The sheet P onto which the color image is transferred is subjected to heat and pressure while passing between the heating roller 43 and the pressure roller 44 of the fixing unit 21, thereby thermally fixing the color image onto the sheet P.

(5) Discharging Operation

A discharge tray 47 is formed on a top surface of the main casing 2. The sheet P is discharged to the discharge tray 47. Further, a discharge unit 48 is provided at an upper rear end portion of the main casing 2. The discharge unit 48 protrudes higher than the discharge tray 47.

A discharge port 49 for discharging the sheet P is formed in the discharge unit 48 at a position above the discharge tray 47. The discharge unit 48 includes, within the discharge port 49, a plurality of (two in the embodiment) discharge rollers 50 for conveying the sheet P to the discharge tray 47.

The sheet P onto which the color toner image is fixed in the fixing unit 21 is discharged onto the discharge tray 47 by the discharge rollers 50.

2. Process Unit (1) Drum Unit

Each of the plurality of drum units 23 has a drum frame 55. The drum frame 55 is formed in a substantially box-like shape in which an upper side, a lower side, and a front side are opened. As described above, the drum unit 23 integrally supports the photosensitive drum 26 and the scorotron charger 27 in the drum frame 55.

(2) Developing Drawer

The developing drawer 24 includes a developing drawer frame 57.

The developing drawer frame 57 has a frame-like structure, with a closed bottom, that is substantially rectangular in a plan view. The developing drawer frame 57 is movable along the front-rear direction between an inside position illustrated in FIG. 1 at which the developing drawer frame 57 is positioned inside the main casing 2 and an outside position illustrated in FIG. 5 at which the developing drawer frame 57 is withdrawn from the main casing 2. As illustrated in FIG. 1, the developing drawer frame 57 includes a pair of side walls (not illustrated), a front wall 58, a rear wall 59, a plurality of (three in the embodiment) partitioning walls 60, and a bottom wall 61.

The pair of side walls is each formed in a flat plate shape that is substantially rectangular in a side view and is elongated in the front-rear direction. The pair of side walls is disposed opposite to and spaced apart from each other in the left-right direction.

The front wall 58 bridges between front edges of the side walls. The front wall 58 is formed in a substantially flat plate shape that is elongated in the left-right direction. The front wall 58 includes a pair of front rollers 63, a pair of translation cam biasing portions 64, and a grip portion 65.

The pair of front rollers 63 is rotatably provided one each at outer left and right sides of the front wall 58, more in detail, at outer left and right sides of the pair of side walls (not illustrated). The pair of front rollers 63 is each formed in a substantially cylindrical shape that is elongated in the left-right direction.

The pair of translation cam biasing portions 64 is provided one each at outer left and right end portions of the front wall 58, more in detail, at inner left and right sides of the pair of side walls and at inner left and right sides of the pair of front rollers 63. The pair of translation cam biasing portions 64 is each formed in the front wall 58 so as to be depressed frontward in a substantially rectangular shape from a rear surface of the front wall 58. An inside dimension of the translation cam biasing portion 64 is set so as to be able to receive a cam front end portion 117 of a translation cam 85 (described later). In the translation cam biasing portion 64, a biasing spring (not illustrated) is provided.

The grip portion 65 to be gripped by a user is provided at a front surface of the front wall 58.

The rear wall 59 bridges between rear edges of the side walls. The rear wall 59 is formed in a substantially flat plate shape that is elongated in the left-right direction. The rear wall 59 includes a pair of rear rollers 67, a pair of translation cam retaining portions 68, and a protection member 69.

The pair of rear rollers 67 is rotatably provided one each at outer left and right sides of the rear wall 59, more in detail, at outer left and right sides of the pair of side walls. The pair of rear rollers 67 is each formed in a substantially cylindrical shape that is elongated in the left-right direction. The pair of rear rollers 67 is positioned higher than the pair of front rollers 63 in a vertical direction.

The pair of translation cam retaining portions 68 is provided one each at outer left and right end portions of the rear wall 59, more in detail, at inner left and right sides of the pair of side walls and at inner left and right sides of the pair of rear rollers 67. The pair of translation cam retaining portions 68 is each formed in a substantially rectangular shape, penetrating through the rear wall 59 in the front-rear direction. An inside dimension of the pair of translation cam retaining portions 68 is set so as to be able to receive a cam rear end portion 116 of the translation cam 85 (described later). When being projected in the front-rear direction, the pair of translation cam retaining portions 68 overlaps the pair of translation cam biasing portions 64.

The protection member 69 is formed in a flat plate shape that is substantially rectangular in a plan view, protruding frontward from an upper portion of the rear wall 59. That is, the protection member 69 of the rear wall 59 is fixed to the developing drawer frame 57.

The three partitioning walls 60 are disposed spaced apart from each other in the front-rear direction so as to substantially equally partition a space between the front wall 58 and the rear wall 59 into four. Each of the partitioning walls 60 spans between the pair of side walls and is formed in a substantially flat plate shape that is elongated in the left-right direction. Left and right edges of the partitioning wall 60 in an upper portion thereof are spaced apart from the pair of side walls, since the translation cams 85 of a link mechanism 80 (described later) are provided at positions between outer left and right sides of the upper portion of the partitioning walls 60 and the pair of side walls. Likewise the rear wall 59, each partitioning wall 60 has, at its upper end portion, the protection member 69. That is, the protection member 69 of each partitioning wall 60 is fixed to the developing drawer frame 57. The protection member 69 of the partitioning wall 60 is provided at a height the same as the protection member 69 of the rear wall 59.

The bottom wall 61 bridges between lower edges of the side walls, and extends from a lower edge of the front wall 58 to a lower edge of the rear wall 59 while continuing from lower edges of the plurality of partitioning walls 60. The bottom wall 61 is formed in a flat plate shape that is substantially rectangular in a plan view. A plurality of (four in the embodiment) raised portions 71 provided at the bottom wall 61.

The raised portions 71 are provided rearward of the front wall 58 and the plurality of partitioning walls 60, respectively, so as to be spaced apart therefrom. Each raised portion 71 is formed in a substantially triangular shape in a side cross-sectional view that protrudes upward from an upper surface of the bottom wall 61 such that a front-rear length thereof becomes shorter toward its upper side. Left and right edges of the bottom wall 61 are spaced apart from the pair of side walls, since the link mechanism 80 (described later) is provided at a position between outer left and right sides of the bottom wall 61 and the pair of side walls.

In the developing drawer frame 57, three spaces each surrounded by the partitioning wall 60, the raised portion 71 provided rearward of and opposed to the partitioning wall 60, the bottom wall 61, and the pair of side walls, and a space surrounded by the front wall 58, the frontmost raised portion 71, the bottom wall 61, and the pair of side walls are defined as a plurality of (four in the embodiment) cartridge accommodating portions 72.

The plurality of developing units 29 is each detachably accommodated in the corresponding cartridge accommodating portion 72. Each developing unit 29 has a developing frame 52 formed in a substantially box-like shape with an upper rear opening, and integrally supports, in the developing frame 52, the developing roller 31, the toner supply roller (not illustrated), and the layer thickness regulating blade (not illustrated), as described above.

In the developing drawer frame 57, three spaces each surrounded by the partitioning wall 60, the raised portion 71 provided frontward of and opposed to the partitioning wall 60, the bottom wall 61, and the pair of side walls, and a space surrounded by the rear wall 59, the rearmost raised portion 71, the bottom wall 61, and the pair of side walls are defined as a plurality of (four in the embodiment) LED unit accommodating portions 73.

The plurality of LED units 35 is each pivotally movably supported by the developing drawer frame 57 and accommodated in the corresponding LED unit accommodating portion 73 when being disposed at a protected position (described later).

3. LED Unit

Figures 6A, 6B, 6C, 6D, 6E:
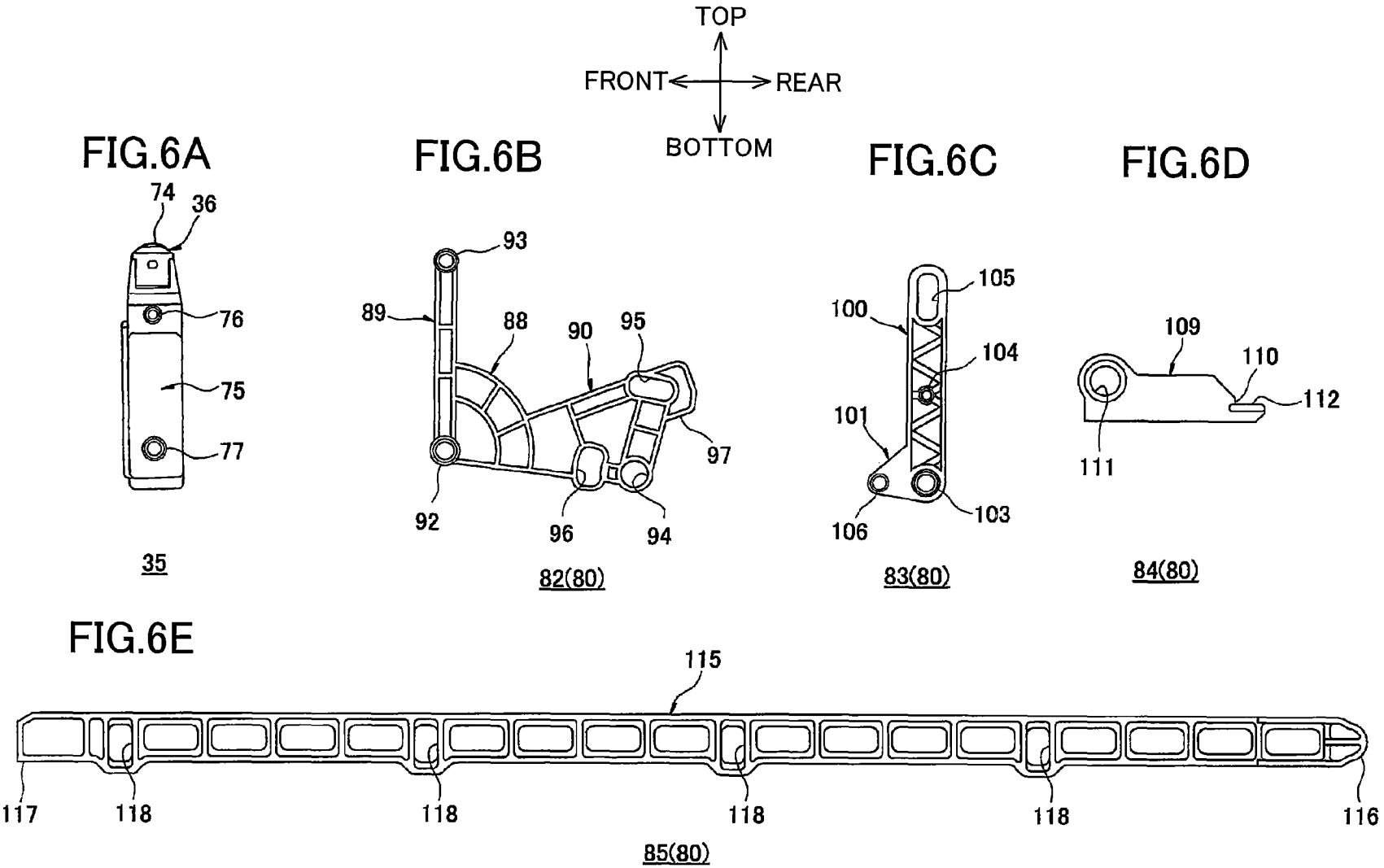

As illustrated in FIG. 6A, each of the plurality of LED units 35 includes the LED array 36 and a body portion 75.

The LED array 36 is formed in a substantially bar-like shape that is elongated in the left-right direction. The LED array 36 integrally supports a large number of LEDs arrayed in the left-right direction. The LED array 36 has a front-rear length smaller than that of the protection member 69, and a left-right length smaller than that of the protection member 69. The LED array 36 includes a pair of positioning portions 74.

The pair of positioning portions 74 is each formed in a: substantially semicircular shape in a side view protruding upward from an upper surface of a left-right end portion of the LED array 36.

The body portion 75 has a rectangular frame-like structure with a closed bottom and an open top, and is elongated in the left-right direction. The LED array 36 is assembled to an inside of the body portion 75 such that an upper portion of the LED array 36 is exposed through the top opening. The body portion 75 includes a pair of LED first bosses 76 and a pair of LED second bosses 77.

The pair of LED first bosses 76 is each formed in a substantially cylindrical shape extending outward in the left-right direction from a left-right surface of the body portion 75 at its upper portion.

The pair of LED second bosses 77 is each formed in a substantially cylindrical shape extending outward in the left-right direction from a left-right surface of the body portion 75 at its lower portion.

The LED unit 35 is constantly biased toward the corresponding photosensitive drum 26 by a biasing spring (not illustrated).

Figure 3:
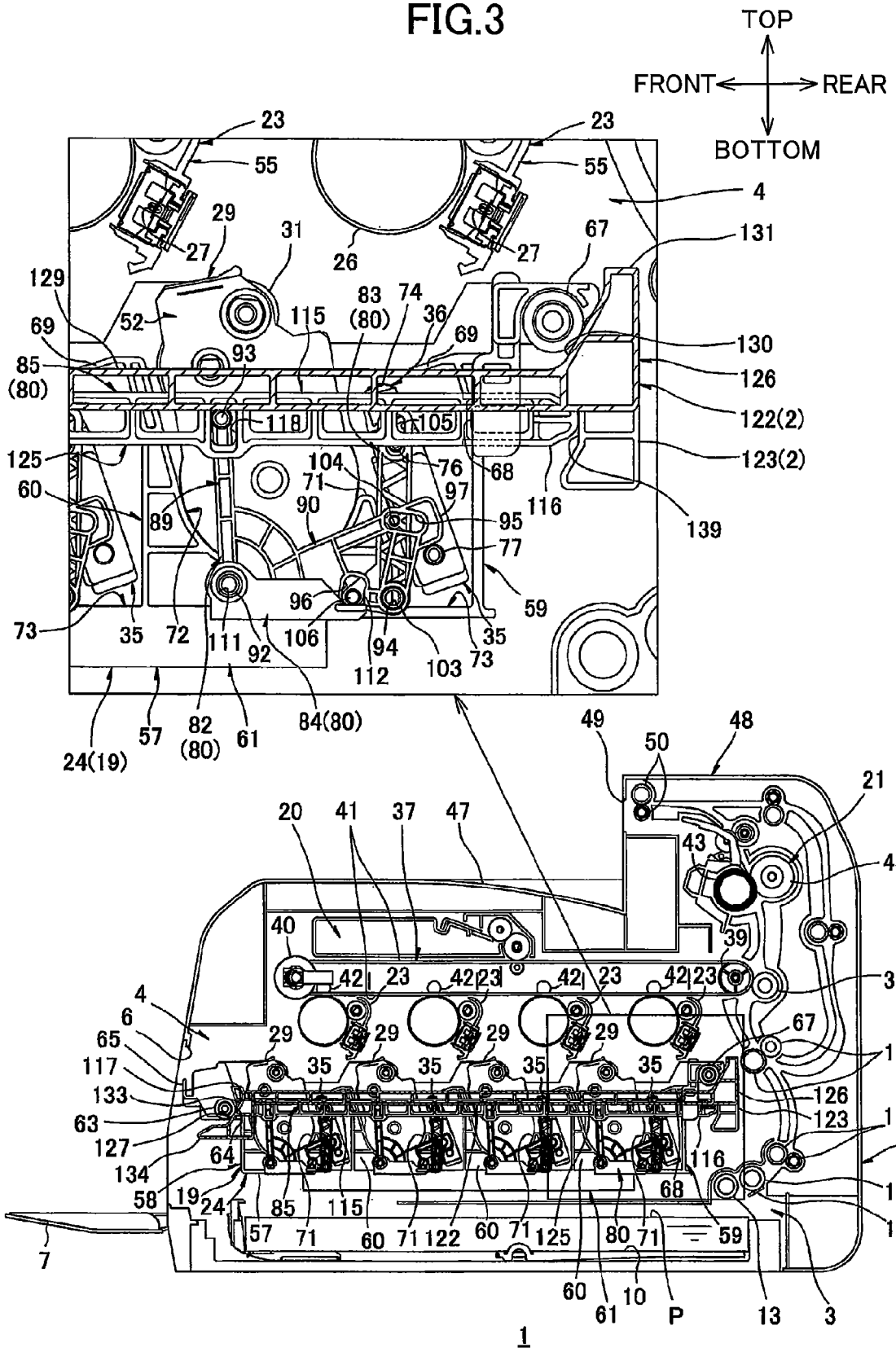
FIG. 3 is an explanatory view for explaining the interlocking motion of the LED units continued from FIG. 2, in which the LED units are disposed at a retracted position.
Figure 4:
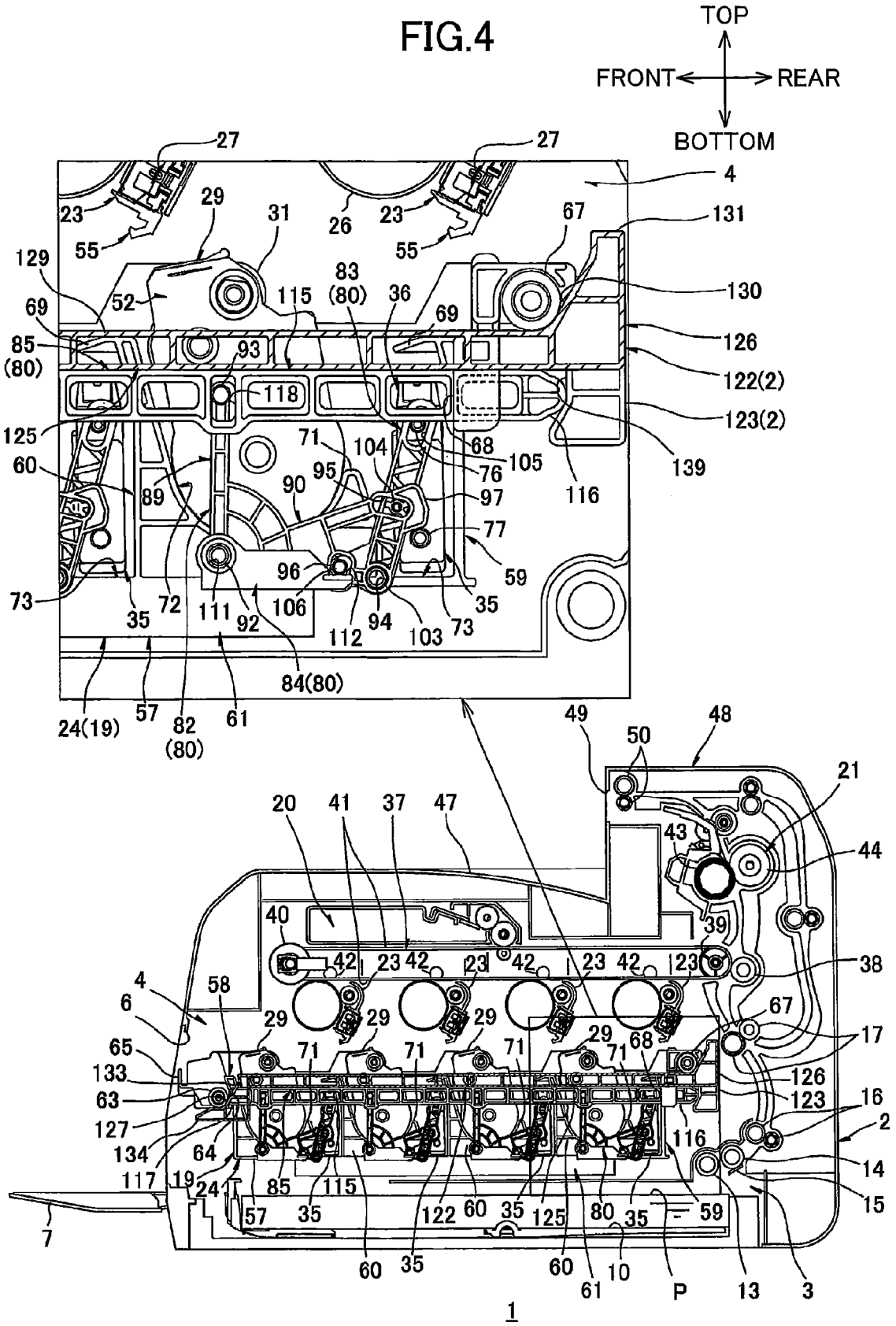
FIG. 4 is an explanatory view for explaining the interlocking motion of the LED units continued from FIG. 3, in which the LED units are disposed at a protected position.

In a state where the developing drawer frame 57 is disposed at the inside position, the LED unit 35 is movable to an exposing position illustrated in FIG. 1, a retracted position illustrated in FIG. 3, and the protected position illustrated in FIG. 4. In the exposing position, the LED array 36 exposes a surface of the corresponding photosensitive drum 26 to light from a lower-rear side thereof. In the retracted position, the LED array 36 is spaced away from the corresponding photosensitive drum 26. In the protected position, the LED array 36 is protected by the corresponding protection member 69.

4. Link Mechanism

Figure 5:
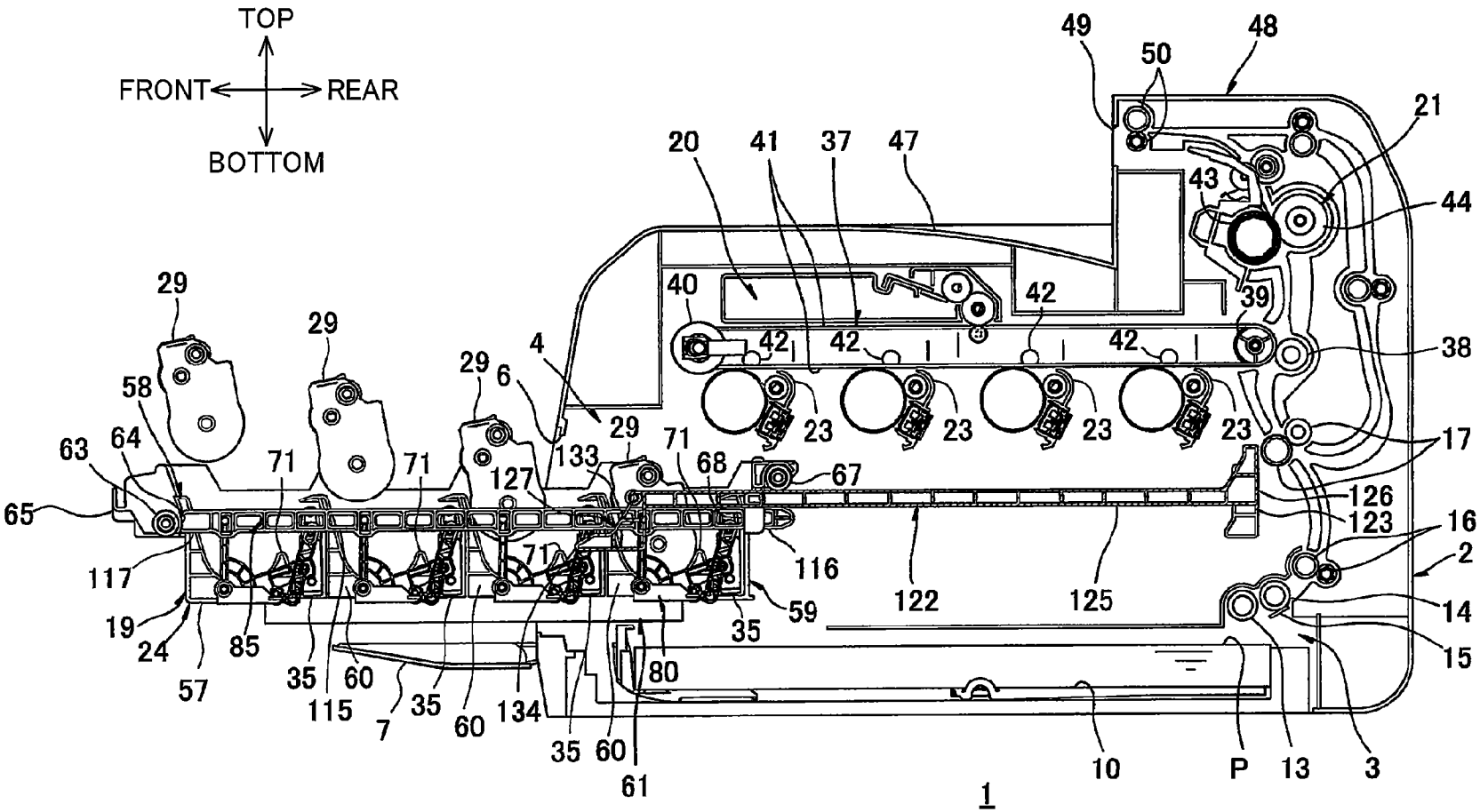
FIG. 5 is an explanatory view for explaining the interlocking motion of the LED units continued from FIG. 4, in which the developing drawer frame is disposed at an outside position.

The developing drawer frame 57 includes the link mechanism 80 configured to move each LED unit 35 to the exposing position (see FIG. 1), the retracted position (see FIG. 3), and the protected position (see FIG. 4) in association with the movement of the developing drawer frame 57 with respect to the main casing 2 between the inside position (see FIG. 1) and the outside position (see FIG. 5).

As illustrated in FIG. 1, the link mechanism 80 includes, corresponding to the number of the LED units 35, a plurality of (four in the embodiment) pairs of pivot plates 82, a plurality of (four in the embodiment) pairs of interlocking plates 83, and a plurality of (four in the embodiment) pairs of base plates 84. The link mechanism 80 further includes a pair of translation cams 85.

In the following description relating to the link mechanism 80, the rearmost pivot plate 82, the rearmost interlocking plate 83, and the rearmost base plate 84 will be described with reference to enlarged views of FIGS. 1 to 5 and detailed views of FIGS. 6A to 6E. Description of the remaining pivot plates 82, the remaining interlocking plates 83, and the remaining base plates 84 will be omitted.

(1) Pivot Plate

As illustrated in FIG. 6B, the pivot plate 82 includes a sector-shaped portion 88, a boss supporting portion 89, and an interlocking plate supporting portion 90.

The sector-shaped portion 88 is formed in a flat plate shape that is substantially sectorial in a side view having a central angle of about 100 degrees and spreading toward an upper-rear side thereof. The sector-shaped portion 88 includes a pivot plate shaft 92.

The pivot plate shaft 92 is provided at a lower-front end portion of the sector-shaped portion 88. That is, the pivot plate shaft 92 is positioned at a center of a curvature of the sector-shaped portion 88. The pivot plate shaft 92 is formed in a substantially cylindrical shape protruding outward in the left-right direction from an inner left-right surface of the sector-shaped portion 88.

The boss supporting portion 89 is formed in a substantially bar-like shape. The boss supporting portion 89 continues from an upper end portion of the sector-shaped portion 88 and extends upward along a front edge of the sector-shaped portion 88. The boss supporting portion 89 includes a pivot plate boss 93.

The pivot plate boss 93 is provided at an upper end portion of the boss supporting portion 89. The pivot plate boss 93 is formed in a substantially cylindrical shape protruding outward in the left-right direction from an inner left-right surface of the boss supporting portion 89.

The interlocking plate supporting portion 90 is formed in a flat plate shape that is substantially trapezoidal in a side view. The interlocking plate supporting portion 90 continues from a lower-rear edge of the sector-shaped portion 88 and extends rearward therefrom. A vertical length of the interlocking plate supporting portion 90 becomes longer toward a rear side thereof. The interlocking plate supporting portion 90 includes an interlocking plate shaft receiving hole 94, an interlocking plate first boss receiving hole 95, an interlocking plate second boss receiving hole 96, and an LED pressing portion 97.

The interlocking plate shaft receiving hole 94 is formed in a circular shape in a side view. The interlocking plate shaft receiving hole 94 penetrates through a lower-rear end portion of the interlocking plate supporting portion 90 so as to be able to receive an interlocking plate shaft 103 (described later) of the interlocking plate 83.

The interlocking plate first boss receiving hole 95 is positioned above the interlocking plate shaft receiving hole 94. The interlocking plate first boss receiving hole 95 is formed as an elongated hole that is elongated in the front-rear direction so as to have a curvature radius centering on the interlocking plate shaft receiving hole 94. The interlocking plate first boss receiving hole 95 penetrates through the interlocking plate supporting portion 90 in the left-right direction. The interlocking plate first boss receiving hole 95 has a vertical length large enough to receive an interlocking plate first boss 104 (described later) of the interlocking plate 83.

The interlocking plate second boss receiving hole 96 is positioned frontward of the interlocking plate shaft receiving hole 94. The interlocking plate second boss receiving hole 96 is formed as an elongated hole that is elongated in the vertical direction so as to have a curvature radius centering on the interlocking plate shaft receiving hole 94. The interlocking plate second boss receiving hole 96 penetrates through the interlocking plate supporting portion 90 in the left-right direction. The interlocking plate second boss receiving hole 96 has a front-rear length large enough to receive an interlocking plate second boss 106 (described later) of the interlocking plate 83.

The LED pressing portion 97 is provided frontward of the interlocking plate first boss receiving hole 95. The LED pressing portion 97 is formed in a flat plate shape that is substantially rectangular in a side view. The LED pressing portion 97 protrudes rearward.

(2) Interlocking Plate

As illustrated in FIG. 6C, the interlocking plate 83 includes a crosspiece portion 100 and a triangle portion 101.

The crosspiece portion 100 is formed so as to extend in the vertical direction and to have a substantially lattice shape in a ¾ (three-fourths) range in the vertical direction around a center thereof. The crosspiece portion 100 includes the interlocking plate shaft 103, the interlocking plate first boss 104, and an LED support elongated hole 105.

The interlocking plate shaft 103 is formed in a substantially cylindrical shape penetrating through a lower end portion of the crosspiece portion 100 and protruding outward in the left-right direction from an inner left-right surface of the crosspiece portion 100.

The interlocking plate first boss 104 is provided at substantially a vertical center region of the crosspiece portion 100. The interlocking plate first boss 104 is formed in a substantially cylindrical shape connected to a part of the lattice of the crosspiece portion 100. The interlocking plate first boss 104 protrudes outward in the left-right direction from the inner left-right surface of the crosspiece portion 100.

The LED supporting elongated hole 105 is formed as an elongated hole that is elongated in the vertical direction and that penetrates through an upper end portion of the crosspiece portion 100 in the left-right direction. The LED supporting elongated hole 105 has a front-rear length large enough to receive the LED first boss 76.

The triangle portion 101 is formed in a flat plate shape that is substantially triangular in a side view. The triangle portion 101 protrudes frontward from a front edge of the crosspiece portion 100 at a lower end portion thereof. A vertical length of the triangle portion 101 becomes shorter toward the front side. The triangle portion 101 includes the interlocking plate second boss 106.

The interlocking plate second boss 106 is formed in a substantially cylindrical shape penetrating through a front end portion of the triangle portion 101 and protruding outward in the left-right direction from an inner left-right surface of the triangle portion 101.

(3) Base Plate

As illustrated in FIG. 6D, the base plate 84 includes a main body portion 109.

The main body portion 109 is formed in a flat plate shape that is substantially rectangular in a side view and elongated in the front-rear direction. The main body portion 109 has, at its rear end portion, a cutout portion 110 obtained by cutting downward the rear end portion from an upper side thereof. The main body portion 109 includes a pivot plate shaft receiving hole 111 and an interlocking plate second boss restricting portion 112.

The pivot plate shaft receiving hole 111 is formed in a circular shape in a side view. The pivot plate shaft receiving hole 111 penetrates through an upper-front end portion of the main body portion 109 so as to be able to receive the pivot plate shaft 92.

The interlocking plate second boss restricting portion 112 is formed in a substantially bar-like shape disposed on a lower edge defining the cutout portion 110.

(4) Translation Cam

As illustrated in FIG. 6E, the translation cam 85 includes a cam linear portion 115, the cam rear end portion 116, and the cam front end portion 117.

The cam linear portion 115 is formed in a substantially ladder shape extending in the front-rear direction. A plurality of (four in the embodiment) pivot plate boss receiving holes 118 are formed in the cam linear portion 115.

The pivot plate boss receiving holes 118 are each formed as an elongated hole that is elongated in the vertical direction and that penetrates, in the left-right direction, a front end portion of each of four areas obtained by substantially equally dividing the cam linear portion 115. The pivot plate boss receiving hole 118 has a front-rear length large enough to receive the pivot plate boss 93.

The cam rear end portion 116 is formed in a flat plate shape that is substantially semicircular in a side view. The cam rear end portion 116 continues from a rear end portion of the cam linear portion 115 and protrudes rearward to form a curved rear edge.

The cam front end portion 117 is formed in a flat plate shape that is substantially rectangular in a side view. The cam front end portion 117 continues from a front end portion of the cam linear portion 115 and protrudes frontward. The cam front end portion 117 has a chamfered upper-front end portion.

(5) Assembled State Between Link Mechanism and LED Unit

The link mechanism 80 (the plurality of pairs of pivot plates 82, the plurality of pairs of interlocking plates 83, the plurality of pairs of base plates 84, and the pair of translation cams 85) is assembled to the developing drawer frame 57 so as to movably support the plurality of LED units 35 relative to the developing drawer frame 57.

Specifically, as illustrated in FIGS. 1 and 5, the pair of translation cams 85 is supported by the front wall 58 and the rear wall 59 of the developing drawer frame 57 so as to be movable relative to the developing drawer frame 57. More in detail, the cam rear end portion 116 of the translation cam 85 is inserted through the translation cam retaining portion 68 of the rear wall 59 so as to protrude rearward from the rear wall 59, and the cam front end portion 117 is received by the translation cam biasing portion 64 of the front wall 58 and is constantly biased rearward by the biasing spring (not illustrated) in the translation cam biasing portion 64.

The pairs of base plates 84 are fixed to the developing drawer frame 57 so as to interpose respective portions of the bottom wall 61 existing rearward of the corresponding partitioning walls 60 therebetween from outer left and right sides of the bottom wall 61.

Each pivot plate 82 is pivotally movably supported to the corresponding base plate 84 as a result of insertion of the pivot plate shaft 92 thereof through the pivot plate shaft receiving hole 111 of the base plate 84. Further, the pivot plate 82 is assembled to the corresponding translation cam 85 so as to be pivotally movable relative to the translation cam 85 as a result of insertion of the pivot plate boss 93 thereof through the corresponding pivot plate boss receiving hole 118 of the translation cam 85.

Each interlocking plate 83 is pivotally movably supported relative to the corresponding pivot plate 82 as a result of insertion of the interlocking plate shaft 103 thereof through the interlocking plate shaft receiving hole 94 of the pivot plate 82. Further, the interlocking plate 83 is restricted in terms of angle of pivotal movement thereof relative to the corresponding pivot plate 82 as a result of insertion of the interlocking plate first boss 104 thereof through the interlocking plate first boss receiving hole 95 of the pivot plate 82 and insertion of the interlocking plate second boss 106 thereof through the interlocking plate second boss receiving hole 96 of the pivot plate 82.

In each LED unit 35, the LED first boss 76 is inserted through the LED supporting elongated hole 105 of the corresponding interlocking plate 83, and the LED second boss 77 is disposed below the LED pressing portion 97 of the corresponding pivot plate 82.

In this manner, each of the plurality of LED units 35 is movably supported to the developing drawer frame 57 through the link mechanism 80.

5. Main Casing

In the main casing 2, a pair of guide rails 122 and a pair of abutment walls 123 are provided.

The pair of guide rails 122 is provided one each on an inner left-right surface of left and right walls of the main casing 2. Each guide rail 122 includes a guide linear portion 125, a guide rear end portion 126, and a guide front end portion 127.

The guide linear portion 125 is formed in a substantially ladder shape extending in the front-rear direction. The guide linear portion 125 has an upper surface serving as a guide surface 129. The guide surface 129 is a horizontal surface extending in the front-rear direction.

The guide rear end portion 126 is formed in a flat plate shape that is substantially trapezoidal in a side view. The guide rear end portion 126 continues from a rear end portion of the guide linear portion 125 and extends upward. The guide rear end portion 126 has a front surface that is inclined rearward toward an upper side thereof and then extends upward in the vertical direction from an inclination end point. The inclined portion of the front surface of the guide rear end portion 126 serves as a first sloped surface 130 that is a slope extending upward toward the rear side (i.e. in a direction connecting the lower-front side and the upper-rear side). An upper surface of the guide rear end portion 126 serves as a placement surface 131 that is a horizontal surface extending in the front-rear direction.

The guide front end portion 127 includes a trapezoid portion 133 and an auxiliary portion 134.

The trapezoid portion 133 is formed into a flat plate shape that is substantially trapezoidal in a side view. The trapezoid portion 133 continues from a front end portion of the guide linear portion 125 and extends downward. A front surface of the trapezoid portion 133 is inclined frontward toward a lower side thereof. The trapezoid portion 133 has a front sloped surface having an inclination angle the same as that of the first sloped surface 130.

The auxiliary portion 134 is formed so as to protrude frontward from a lower-front end portion of the guide linear portion 125.

The pair of abutment walls 123 is provided one each at an inner left-right side of the pair of guide rear end portions 126. The pair of abutment walls 123 overlaps the pair of guide rear end portions 126 when being projected in the left-right direction. Each abutment wall 123 is formed in a substantially ladder shape extending in the vertical direction. A lower end portion of the abutment wall 123 protrudes frontward. The abutment wall 123 has a front surface serving as an abutment surface 139 that is a vertical surface extending in the vertical direction.

6. Interlocking Motion of LED Unit (1) Operation for Withdrawing Developing Drawer Frame from Main Casing Withdrawal of the developing drawer frame 57 from the main casing 2 moves each of the plurality of LED units 35 from the exposing position to the retracted position, and further withdrawal of the developing drawer frame 57 from the main casing 2 moves the LED unit 35 from the retracted position to the protected position.

(1-1) Exposing Position

As illustrated in FIG. 1, in a state where the developing drawer frame 57 is disposed at the inside position and in a state allowing an image formation operation to be carried out, each LED unit 35 is disposed at the exposing position. More in detail, when the developing drawer frame 57 is disposed at the inside position and each LED unit 35 is disposed at the exposing position, each rear roller 67 of the rear wall 59 of the developing drawer frame 57 is placed on the placement surface 131 of the guide rear end portion 126 of the corresponding guide rail 122, and the cam rear end portion 116 of each translation cam 85 abuts against the abutment surface 139 of the corresponding abutment wall 123.

As a result, the developing roller 31 of each developing unit 29 is brought into pressure contact with the corresponding photosensitive drum 26 from the lower-front side, and each translation cam 85 is supported to the developing drawer frame 57 at a position relatively frontward of the developing drawer frame 57 against a biasing force of the biasing spring (not illustrated) of the corresponding translation cam biasing portion 64.

Each pivot plate 82 is supported by the corresponding base plate 84 such that the boss supporting portion 89 is inclined frontward about the pivot plate shaft 92, and each pivot plate boss 93 is inserted through the corresponding pivot plate boss receiving hole 118 of the corresponding translation cam 85. The interlocking plate supporting portion 90 of the pivot plate 82 is positioned relatively at the upper side in the pivot plate 82.

As a result, the interlocking plate 83 assembled to the pivot plate 82 is positioned relatively at the upper side in the developing drawer frame 57 and, accordingly, the LED unit 35 assembled to the interlocking plate 83 is positioned relatively at the upper side in the developing drawer frame 57.

Each LED unit 35 is supported by the link mechanism 80 so as to be positioned relatively at the upper side in the developing drawer frame 57, and the LED array 36 of the LED unit 35 is biased toward the corresponding photosensitive drum 26 from the lower-rear side by the biasing spring (not illustrated), and the pair of positioning portions 74 of the LED array 36 is made to abut against left and right end portions of the photosensitive drum 26 from the lower-rear side, whereby a distance between a large number of LEDs of the LED array 36 and the photosensitive drum 26 is kept constant.

In this manner, each LED unit 35 is disposed at the exposing position.

(1-2) Retracted Position

In the course of withdrawing the developing drawer frame 57 in which each LED unit 35 is disposed at the exposing position from the main casing 2, each LED unit 35 is disposed at the retracted position. In other words, when the developing drawer frame 57 in which each LED unit 35 is disposed at the exposing position is being withdrawn from the main casing 2, each LED unit 35 is moved from the exposing position to the retracted position.

Figure 2:
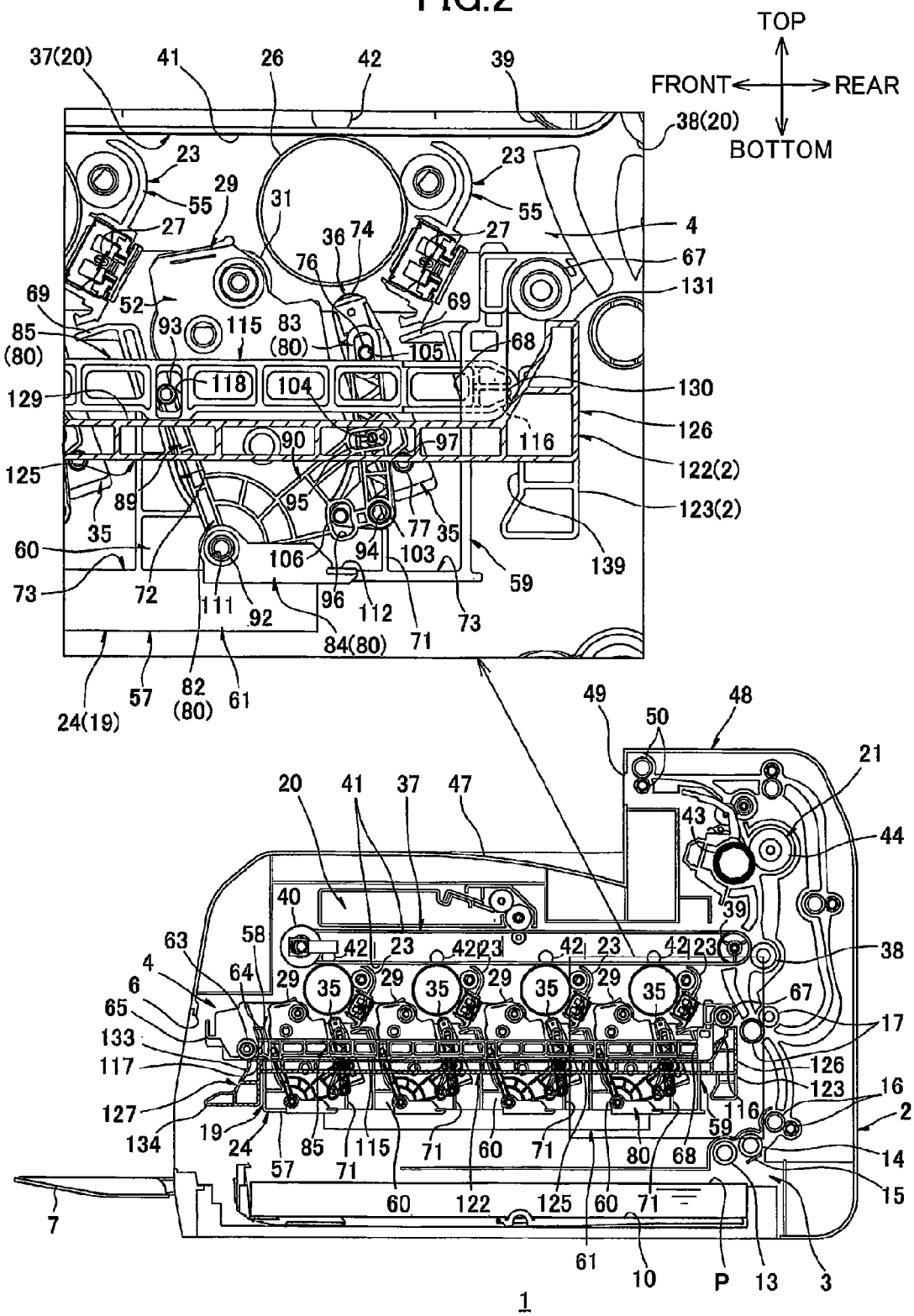
FIG. 2 is an explanatory view for explaining interlocking motion of the LED units of FIG. 1, in which a front cover is disposed at an open position and the developing drawer frame is slightly withdrawn from a main casing.

In order to withdraw the developing drawer frame 57 from the main casing 2, as illustrated in FIG. 2, first the front cover 7 is pivotally moved to its open position to expose the opening 6.

Then, a user grips the grip portion 65 of the front wall 58 to withdraw the developing drawer frame 57 from the main casing 2.

Accordingly, each rear roller 67 of the rear wall 59 is moved on the placement surface 131 of the guide rear end portion 126 of the corresponding guide rail 122 along the placement surface 131, and each front roller 63 of the front wall 58 is moved frontward along the guide surface 129 of the guide linear portion 125 of the corresponding guide rail 122 at its front end portion.

At this time, the developing drawer frame 57 is moved relatively frontward with respect to the main casing 2. However, each translation cam 85 is constantly biased rearward by the biasing force of the biasing spring (not illustrated) of the corresponding translation cam biasing portion 64, so that a state where the cam rear end portion 116 of the translation cam 85 abuts against the corresponding abutment surface 139 is maintained. In other words, the translation cam 85 is moved relatively rearward with respect to the developing drawer frame 57.

As a result, the pivot plate boss 93 of each pivot plate 82 is moved relatively rearward with respect to the developing drawer frame 57, following the movement of the corresponding translation cam 85, and the pivot plate 82 is pivotally moved clockwise in a right side view about the pivot plate shaft 92.

Accordingly, the LED pressing portion 97 of the pivot plate 82 abuts against the LED second boss 77 of the corresponding LED unit 35 from the upper-front side to press and move the LED unit 35 below and rearward.

In this manner, the LED array 36 of the LED unit 35 and the surface of the corresponding photosensitive drum 26 are spaced away from each other.

Further, in the front-rear direction, the developing drawer frame 57 is moved relatively frontward with respect to the main casing 2, whereby the photosensitive drum 26 and the developing roller 31 of the corresponding developing unit 29 are spaced away from each other.

Then, as illustrated in FIG. 3, when the developing drawer frame 57 is further withdrawn from the main casing 2, each rear roller 67 of the rear wall 59 is moved below and frontward along the first sloped surface 130 of the guide rear end portion 126 of the corresponding guide rail 122, and each front roller 63 of the front wall 58 is moved below and frontward along the sloped surface that is formed in the trapezoid portion 133 of the guide front end portion 127 of the corresponding guide rail 122 and that has the same inclination angle as that of the first sloped surface 130.

As a result, in the front-rear direction, the developing drawer frame 57 is moved relatively further frontward with respect to the main casing 2. However, each translation cam 85 is constantly biased rearward by the biasing force of the biasing spring (not illustrated) of the corresponding translation cam biasing portion 64, so that a state where the cam rear end portion 116 of the translation cam 85 abuts against the corresponding abutment surface 139 is maintained.

As a result, the pivot plate boss 93 of each pivot plate 82 is moved relatively rearward with respect to the developing drawer frame 57, following the movement of the corresponding translation cam 85, and the pivot plate 82 is pivotally moved further clockwise in a right side view about the pivot plate shaft 92.

Accordingly, the LED pressing portion 97 of the pivot plate 82 further presses the LED second boss 77 of the corresponding LED unit 35 from the upper-front side to move the LED unit 35 below and rearward.

In this manner, each LED unit 35 is disposed at the retracted position.

At this time, the LED unit 35 is pivotally moved relatively counterclockwise in a right side view with respect to the corresponding pivot plate 82 about an abutment point where the LED pressing portion 97 abuts against the LED second boss 77.

Then, the interlocking plate 83 pivotally movably connected to the LED unit 35 is also pivotally moved relatively counterclockwise in a right side view with respect to the corresponding pivot plate 82 about the interlocking plate shaft 103.

As a result, the interlocking plate first boss 104 is disposed at a front portion of the corresponding interlocking plate first boss receiving hole 95, and the interlocking plate second boss 106 is disposed at a lower portion of the corresponding interlocking plate second boss receiving hole 96.

Further, in the vertical direction, the developing drawer frame 57 is moved relatively downward with respect to the main casing 2, the photosensitive drum 26 and the developing roller 31 of the corresponding developing unit 29 are spaced further away from each other.

(1-3) Protected Position

In the course of withdrawing the developing drawer frame 57 in which each LED unit 35 is disposed at the retracted position from the main casing 2, each LED unit 35 is disposed at the protected position. In other words, when the developing drawer frame 57 in which each LED unit 35 is disposed at the retracted position is being further withdrawn from the main casing 2, each LED unit 35 is moved from the retracted position to the protected position.

Specifically, as illustrated in FIG. 4, when the developing drawer frame 57 is further withdrawn from the main casing 2, each rear roller 67 of the rear wall 59 is moved from the first sloped surface 130 of the guide rear end portion 126 of the corresponding guide rail 122 onto the guide surface 129 of the guide linear portion 125 of the guide rail 122, and each front roller 63 of the front wall 58 is moved from the trapezoid portion 133 of the guide front end portion 127 of the corresponding guide rail 122 onto the auxiliary portion 134 of the guide front end portion 127 of the guide rail 122.

As a result, in the front-rear direction, the developing drawer frame 57 is moved relatively further frontward with respect to the main casing 2. However, each translation cam 85 is constantly biased rearward by the biasing force of the biasing spring (not illustrated) of the corresponding translation cam biasing portion 64, so that a state where the cam rear end portion 116 of the translation cam 85 abuts against the corresponding abutment surface 139 is maintained.

As a result, the pivot plate boss 93 of each pivot plate 82 is moved relatively further rearward with respect to the developing drawer frame 57, following the movement of the corresponding translation cam 85, and the pivot plate 82 is pivotally moved further clockwise in a right side view about the pivot plate shaft 92.

Accordingly, the interlocking plate second boss 106 of the interlocking plate 83 abuts against the interlocking plate second boss restricting portion 112 of the corresponding base plate 84 from above to restrict the movement of the interlocking plate 83 relative to the developing drawer frame 57, and the interlocking plate second boss 106 is moved from the lower portion of the corresponding interlocking plate second boss receiving hole 96 to an upper portion of the interlocking plate second boss receiving hole 96. Further, the interlocking plate first boss 104 of the interlocking plate 83 is moved from the front portion of the corresponding interlocking plate first boss receiving hole 95 to a rear portion of the interlocking plate first boss receiving hole 95.

As a result, the interlocking plate 83 is pivotally moved clockwise in a right side view about the interlocking plate shaft 103 to pivotally move the corresponding LED unit 35 clockwise in a right side view about the abutment point where the LED pressing portion 97 abuts against the LED second boss 77 through the LED first boss 76 received in the LED supporting elongated hole 105, thereby moving the LED array 36 below the corresponding protection member 69.

In this manner, each LED unit 35 is disposed at the protected position.

(1-4) Attachment/Detachment of Developing Unit

Then, as illustrated in FIG. 5, when the developing drawer frame 57 in which each LED unit 35 is disposed at the protected position is further withdrawn from the main casing 2, each front roller 63 of the front wall 58 is separated away from the auxiliary portion 134 of the guide front end portion 127 of the corresponding guide rail 122, and each rear roller 67 of the rear wall 59 is moved frontward along the guide surface 129 of the guide linear portion 125 of the corresponding guide rail 122, whereby the developing drawer frame 57 is disposed at the outside position.

At this time, the interlocking plate second boss 106 of the interlocking plate 83 is restricted by the interlocking plate second boss restricting portion 112 of the corresponding base plate 84 to abut against an upper edge defining the interlocking plate second boss receiving hole 96 of the corresponding pivot plate 82, thereby restricting pivotal movement of the pivot plate 82 relative to the base plate 84.

Each translation cam 85 is constantly biased rearward by the biasing force of the biasing spring (not illustrated) of the corresponding translation cam biasing portion 64. In this state, however, the further movement of the pivot plate boss 93 of the pivot plate 82 relative to the corresponding base plate 84 is restricted, so that the rearward movement of the translation cam 85 relative to the developing drawer frame 57 is restricted.

With this configuration, when the developing drawer frame 57 is withdrawn from the main casing 2, the cam rear end portion 116 of each translation cam 85 is separated away from the abutment surface 139 of the corresponding abutment wall 123.

Thereafter, each developing unit 29 is attached to or detached from the developing drawer frame 57 disposed at the outside position. More in detail, in detaching the developing unit 29 from the developing drawer frame 57, the developing unit 29 is pulled upward. In attaching the developing unit 29 to the developing drawer frame 57, the developing unit 29 is inserted, from above, into the developing drawer frame 57 after being positioned at a predetermined position.

In this manner, attachment and detachment of the developing unit 29 relative to the developing drawer frame 57 is completed.

(2) Operation for Inserting Developing Drawer Frame into Main Casing

Insertion of the developing drawer frame 57 into the main casing 2 moves each of the plurality of LED units 35 from the protected position to the retracted position, and further insertion of the developing drawer frame 57 into the main casing 2 moves the LED unit 35 from the retracted position to the exposing position.

In order to mount the developing drawer frame 57 into the main casing 2, the operation described above for withdrawing the developing drawer frame 57 from the main casing 2 is performed in reverse.

Specifically, the developing drawer frame 57 in which each LED unit 35 is disposed at the protected position is inserted into the main casing 2 such that each rear roller 67 of the rear wall 59 is moved rearward along the guide surface 129 of the guide linear portion 125 of the corresponding guide rail 122.

Then, as illustrated in FIG. 4, each rear roller 67 of the rear wall 59 abuts against the first sloped surface 130 of the guide rear end portion 126 of the corresponding guide rail 122, and each front roller 63 of the front wall 58 rises up on the auxiliary portion 134 of the guide front end portion 127 of the corresponding guide rail 122 to abut against the trapezoid portion 133 of the guide front end portion 127 of the guide rail 122.

In this state, the cam rear end portion 116 of each translation cam 85 abuts against the abutment surface 139 of the corresponding abutment wall 123.

Then, as illustrated in FIG. 3, when the developing drawer frame 57 is further inserted into the main casing 2, the rear roller 67 of the rear wall 59 is moved so as to rise up on the first sloped surface 130, and the front roller 63 of the front wall 58 is moved, from the auxiliary portion 134, so as to rise up on the slope of the trapezoid portion 133 having the same inclination angle as that of the first sloped surface 130.

As a result, in the front-rear direction, the developing drawer frame 57 is moved relatively rearward with respect to the main casing 2. However, each translation cam 85 is moved relatively frontward with respect to the developing drawer frame 57 against the biasing force of the biasing spring (not illustrated) of the corresponding translation cam biasing portion 64 as a result of abutment of the cam rear end portion 116 of the translation cam 85 against the corresponding abutment surface 139.

Then, the pivot plate boss 93 of the pivot plate 82 is moved relatively frontward with respect to the developing drawer frame 57, following the movement of the corresponding translation cam 85, and the pivot plate 82 is pivotally moved counterclockwise in a right side view about the pivot plate shaft 92.

At this time, restriction on the interlocking plate second boss 106 of the interlocking plate 83 by the interlocking plate second boss restricting portion 112 of the corresponding base plate 84 is released, so that the corresponding LED unit 35 is pivotally moved counterclockwise in a right side view about the LED second boss 77 such that the LED array 36 is opposed to the corresponding photosensitive drum 26 from the lower-rear side.

As a result, each LED unit 35 is disposed at the retracted position.

Then, as illustrated in FIG. 2, when the developing drawer frame 57 in which each LED unit 35 is disposed at the retracted position is further inserted into the main casing 2, each rear roller 67 of the rear wall 59 is moved from the first sloped surface 130 onto the placement surface 131 of the guide rear end portion 126 of the guide rail 122, and each front roller 63 of the front wall 58 is moved from the trapezoid portion 133 onto the guide surface 129 of the guide linear portion 125 of the guide rail 122.

As a result, in the front-rear direction, the developing drawer frame 57 is moved relatively further rearward with respect to the main casing 2. However, each translation cam 85 is moved relatively frontward with respect to the developing drawer frame 57 against the biasing force of the biasing spring (not shown) of the corresponding translation cam biasing portion 64 as a result of abutment of the cam rear end portion 116 of the translation cam 85 against the corresponding abutment surface 139.

Then, the pivot plate boss 93 of the pivot plate 82 is moved relatively further frontward with respect to the developing drawer frame 57, following the movement of the corresponding translation cam 85, and the pivot plate 82 is pivotally moved further counterclockwise in a right side view about the pivot plate shaft 92.

As a result, the interlocking plate supporting portion 90 of the pivot plate 82 is positioned relatively at the upper side in the pivot plate 82, and the corresponding LED unit 35 is moved above and frontward since the LED unit 35 is constantly biased above and frontward by the biasing force of the biasing spring (not illustrated).

Then, when the developing drawer frame 57 is further inserted into the main casing 2, each rear roller 67 of the rear wall 59 is moved rearward along the placement surface 131 of the guide rear end portion 126 of the corresponding guide rail 122, and each front roller 63 of the front wall 58 is moved rearward at the front end portion of the guide surface 129 of the guide linear portion 125 of the corresponding guide rail 122.

As a result, as illustrated in FIG. 1, the pivot plate 82 is pivotally moved further counterclockwise in a right side view about the pivot plate shaft 92, and the pair of positioning portions 74 of the LED array 36 are made to abut against the left and right end portions of the corresponding photosensitive drum 26 from the lower-rear side, whereby the LED array 36 and the photosensitive drum 26 are opposed to each other while a distance between a large number of LEDs of the LED array 36 and the photosensitive drum 26 is kept constant.

Then, the LED pressing portion 97 of the pivot plate 82 is separated away from the LED second boss 77 of the corresponding LED unit 35.

In this manner, each LED unit 35 is disposed at the exposing position.

Then, the front cover 7 is pivotally moved to its closed position to cover the opening 6.

This completes the operation for mounting the developing drawer frame 57 in the main casing 2.

7. Operational Advantages (1) According to the printer 1, the LED unit 35 can expose the photosensitive drum 26 when being disposed at the exposing position as illustrated in FIG. 1, and can be protected by the protection member 69 fixed to the developing drawer frame 57 when being disposed at the protected position as illustrated in FIG. 4. The protection member 69 is fixed to the developing drawer frame 57, so that the number of components thereof can be reduced and strength thereof can be enhanced as compared to a case where such a protection member is pivotally movably provided at the developing drawer frame 57. Thus, even if the developing unit 29 interferes with the protection member 69 at the time of attachment and detachment of the developing unit 29 relative to the developing drawer frame 57, damages to the LED unit 35 disposed at the protected position can be prevented.

Further, during the operation for withdrawing the developing drawer frame 57 from the main casing 2 and also during the operation for inserting the developing drawer frame 57 into the main casing 2, interference between the LED units 35 and other outside components can be prevented.

As a result, each LED unit 35 can be protected reliably, and reliability of the printer 1 can be ensured over a prolonged period of time.

(2) Further, according to the printer 1, as illustrated in FIGS. 2 and 3, when moving the LED unit 35 from the exposing position, the LED unit 35 is first moved in a direction away from the photosensitive drum 26 and then moved to the retracted position. This allows the LED unit 35 to be separated away from the photosensitive drum 26 without sliding-contact with the photosensitive drum 26.

Subsequently, by pivotally moving the LED unit 35 to move the LED unit 35 from the retracted position to the protected position, the LED unit 35 can be protected by the protection member 69 fixed to the developing drawer frame 57, as illustrated in FIG. 4.

Thus, since the LED unit 35 is disposed at the retracted position so as to be spaced away from the photosensitive drum 26, the LED unit 35 can be reliably prevented from slidingly contacting the photosensitive drum 26. Further, since the LED unit 35 is pivotally moved to be disposed at the protected position, the LED unit 35 can be reliably protected by the protection member 69.

As a result, the LED units 35 can be reliably protected to thereby prevent the LED units 35 from being damaged.

(3) Further, according to the printer 1, the LED unit 35 is moved to the exposing position (see FIG. 1), the retracted position (see FIG. 3), and the protected position (see FIG. 4) by the link mechanism 80 provided at the developing drawer frame 57.

That is, by driving the link mechanism 80, the LED unit 35 can be moved to the above respective positions (i.e. exposing position, retracted position, and protected position) easily and reliably.

(4) Further, according to the printer 1, the LED unit 35 is moved between the exposing position illustrated in FIG. 1 and the retracted position illustrated in FIG. 3 by the pair of pivot plates 82 under the drive of the link mechanism 80 and is moved between the retracted position illustrated in FIG. 3 and the protected position illustrated in FIG. 4 by the pair of interlocking plates 83 and the pair of base plates 84 which are coupled to the corresponding pivot plates 82 under the drive of the link mechanism 80.

That is, interlocking each pivot plate 82 with the corresponding interlocking plate 83 and the corresponding base plate 84 allows the LED unit 35 to be easily moved to the above respective positions.

(5) Further, according to the printer 1, the pair of translation cams 85 can be moved relative to the developing drawer frame 57 by the movement of the developing drawer frame 57 from the inside position illustrated in FIG. 1 to the outside position illustrated in FIG. 5. The LED unit 35 can be moved from the exposing position illustrated in FIG. 1 to the retracted position illustrated in FIG. 3 and, further, from the retracted position to the protected position illustrated in FIG. 5 by interlocking the relative movement of the translation cams 85 with respect to the developing drawer frame 57 with the movements of the pivot plates 82, the interlocking plates 83, and the base plates 84.

Thus, by a simple operation for moving the developing drawer frame 57 from the inside position to the outside position, the LED unit 35 can be protected and prevented from being damaged.

(6) Further, according to the printer 1, the LED array 36 of the LED unit 35 is opposed to the photosensitive drum 26 when the LED unit 35 is disposed at the exposing position as illustrated in FIG. 1 and is opposed to the protection member 69 when the LED unit 35 is disposed at the protected position as illustrated in FIG. 4.

Thus, disposing the LED unit 35 at the protected position allows the LED array 36 thereof for exposing the photosensitive drum 26 to be reliably protected by the protection member 69 fixed to the developing drawer frame 57.

As a result, the LED array 36 of the LED unit 35 can be reliably protected and, thus, reliability of the printer 1 can be ensured over a prolonged period of time.

8. Second Embodiment (1) Structure of Printer According to Second Embodiment

A printer 201 as an image forming apparatus according to a second embodiment of the present invention will be described while referring to FIGS. 7 through 9, wherein like parts and components are designated with the same reference numerals to avoid duplicating description. In the following description, only parts differing from those of the first embodiment will be described in detail.

In the above-described first embodiment, the image forming unit 4 includes the process unit 19 at substantially the vertical center region of the main casing 2, as illustrate in FIG. 1. Further, the process unit 19 includes the plurality of drum units 23 and the developing drawer 24.

Each drum unit 23 is provided in the main casing 2 so as not to be movable relative to the main casing 2. The developing drawer 24 includes the plurality of developing units 29 and the plurality of LED units 35. The plurality of developing unit 29 is each attachable to and detachable from the developing drawer frame 57 of the developing drawer 24. The plurality of LED units 35 is each pivotally movable relative to the developing drawer frame 57.

Figure 7:
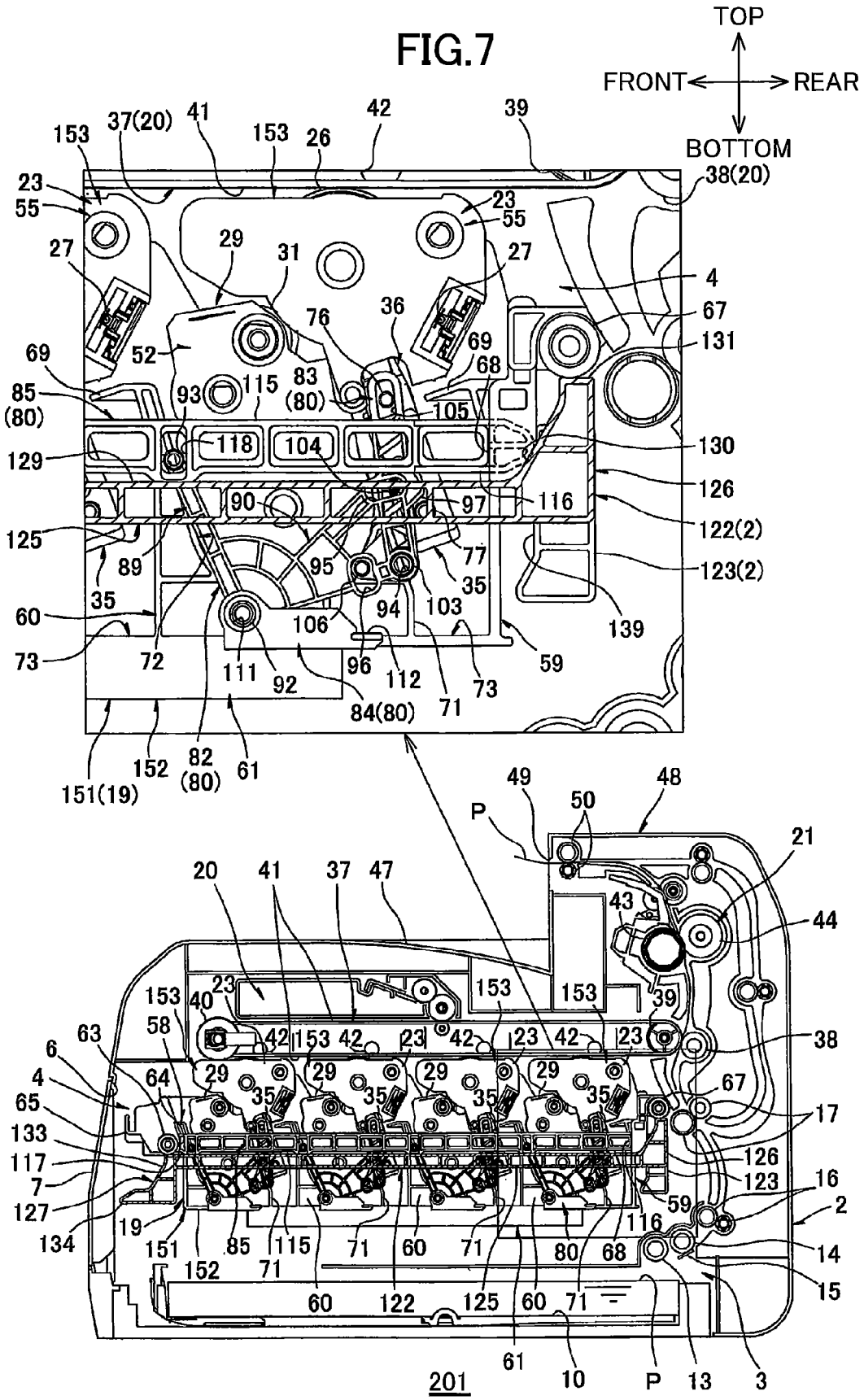
FIG. 7 is a center cross-sectional view of a printer as an image forming apparatus according to a second embodiment of the present invention, and an enlarged view of an essential portion of the printer, in which LED units are disposed at an exposing position and a process drawer frame is disposed at an inside position.

On the other hand, in the second embodiment, the image forming unit 4 includes a process drawer 151 at substantially the vertical center region of the main casing 2, as illustrate in FIG. 7.

The process drawer 151 includes a process drawer frame 152.

The process drawer frame 152 includes a plurality of (four in the embodiment) process cartridges 153 (as an example of a cartridge) and a plurality of (four in the embodiment) LED units 35.

The process drawer frame 152 has a configuration similar to that of the developing drawer frame 57 of the printer 1 according to the first embodiment.

That is, the process drawer frame 152 has a frame-like structure, with a closed bottom, that is substantially rectangular in a plan view. The process drawer frame 152 is movable along the front-rear direction between an inside position illustrated in FIG. 7 at which the process drawer frame 152 is positioned inside the main casing 2 and an outside position illustrated in FIG. 9 at which the process drawer frame 152 is withdrawn from the main casing 2. The process drawer frame 152 includes the pair of side walls (not illustrated), the front wall 58, the rear wall 59, the plurality of partitioning walls 60, and the bottom wall 61, by which the plurality of cartridge accommodating portions 72 and the plurality of LED unit accommodating portions 73 are defined.

Each of the plurality of process cartridges 153 is detachably accommodated in the corresponding cartridge accommodating portion 72. Each process cartridge 153 integrally includes the drum unit 23 and the developing unit 29. The developing roller 31 is supported at the developing unit 29 so as to be in pressure contact with the photosensitive drum 26 of the drum unit 23 from the lower-front side thereof within the drum unit 23. Unlike the first embodiment, each drum unit 23 is connected to the corresponding developing unit 29. The drum units 23 can thus be attachable to and detachable from the process drawer 151 together with the corresponding developing unit 29.

Each LED unit 35 can be moved to an exposing position (see FIG. 7), a retracted position (see FIG. 8A), and a protected position (see FIG. 8B) through the link mechanism 80 in association with the movement of the process drawer frame 152 between the inside position (see FIG. 7) and the outside position (see FIG. 9) relative to the main casing 2. Incidentally, the link mechanism 80 of the second embodiment has the same configuration as that of the link mechanism 80 of the first embodiment.

(2) Interlocking Motion of LED Unit in Second Embodiment (2-1) Operation for Withdrawing Process Drawer Frame from Main Casing Withdrawal of the process drawer frame 152 from the main casing 2 moves each of the plurality of LED units 35 from the exposing position to the retracted position, and further withdrawal of the process drawer frame 152 from the main casing 2 moves the LED unit 35 from the retracted position to the protected position.

Specifically, as illustrated in FIG. 7, in a state where the process drawer frame 152 is disposed at the inside position and in a state allowing an image formation operation to be carried out, each LED unit 35 is disposed at the exposing position, as in the first embodiment.

Figure 8A:
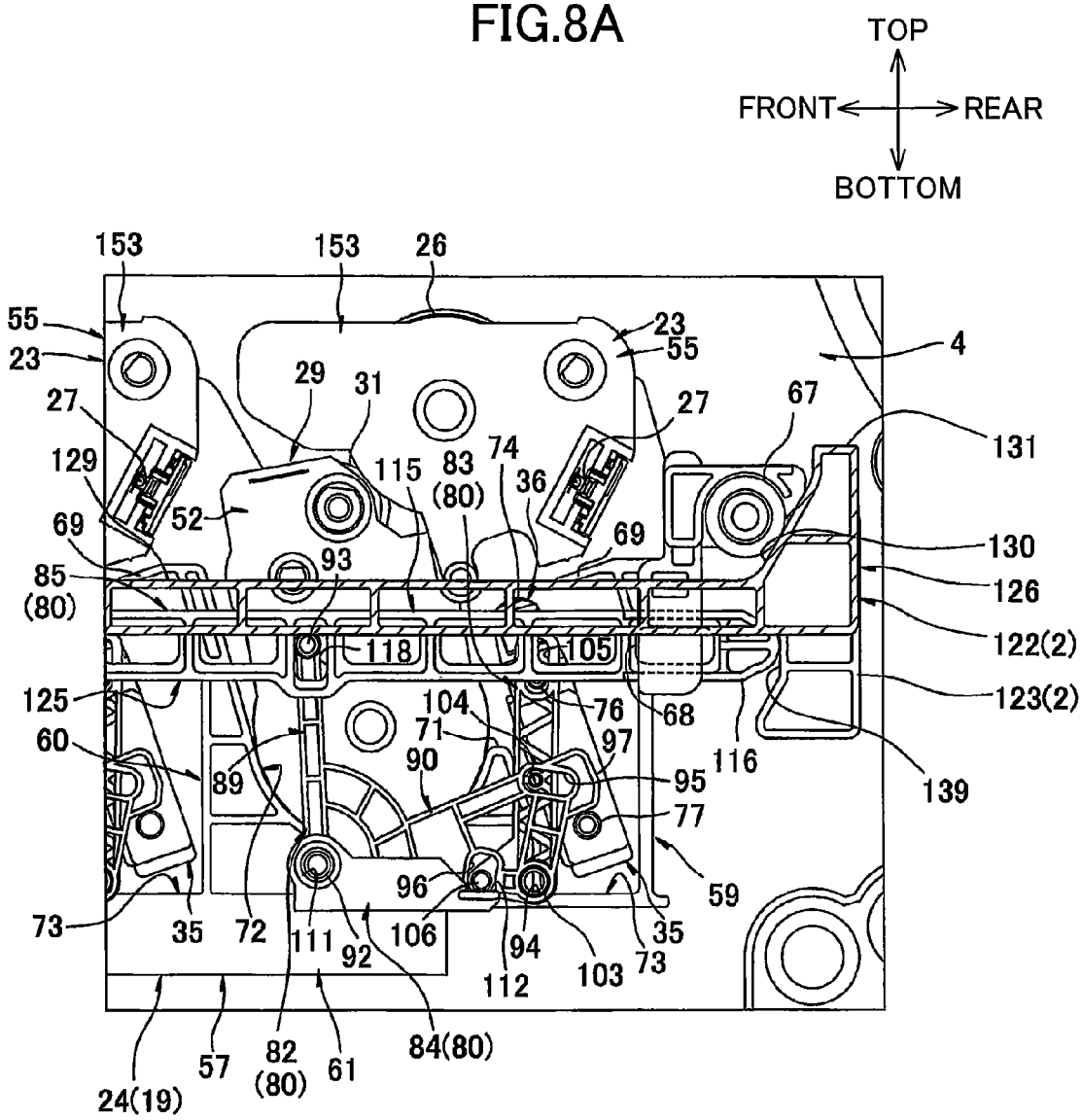

In the course of withdrawing the process drawer frame 152 in which each LED unit 35 is disposed at the exposing position from the main casing 2, each LED unit 35 is disposed at the retracted position as illustrated in FIG. 8A, as in the first embodiment. That is, when the process drawer frame 152 in which each LED unit 35 is disposed at the exposing position is being withdrawn from the main casing 2, each LED unit 35 is moved from the exposing position to the retracted position.

Figure 8B:
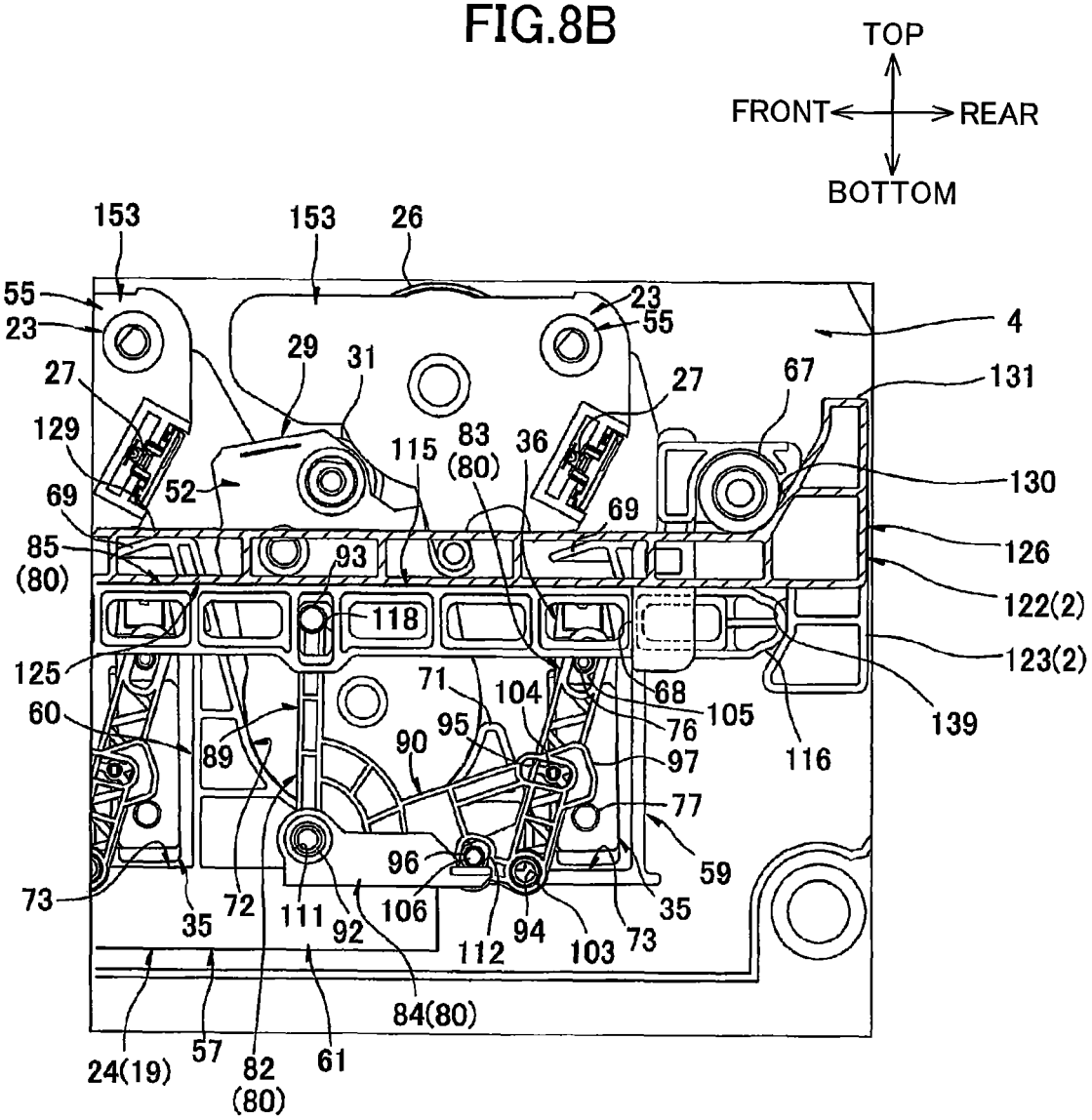

In the course of withdrawing the process drawer frame 152 in which each LED unit 35 is disposed at the retracted position from the main casing 2, each LED unit 35 is disposed at the protected position as illustrated in FIG. 8B, as in the first embodiment. That is, when the process drawer frame 152 in which each LED unit 35 is disposed at the retracted position is being further withdrawn from the main casing 2, each LED unit 35 is moved from the retracted position to the protected position.

Figure 9:
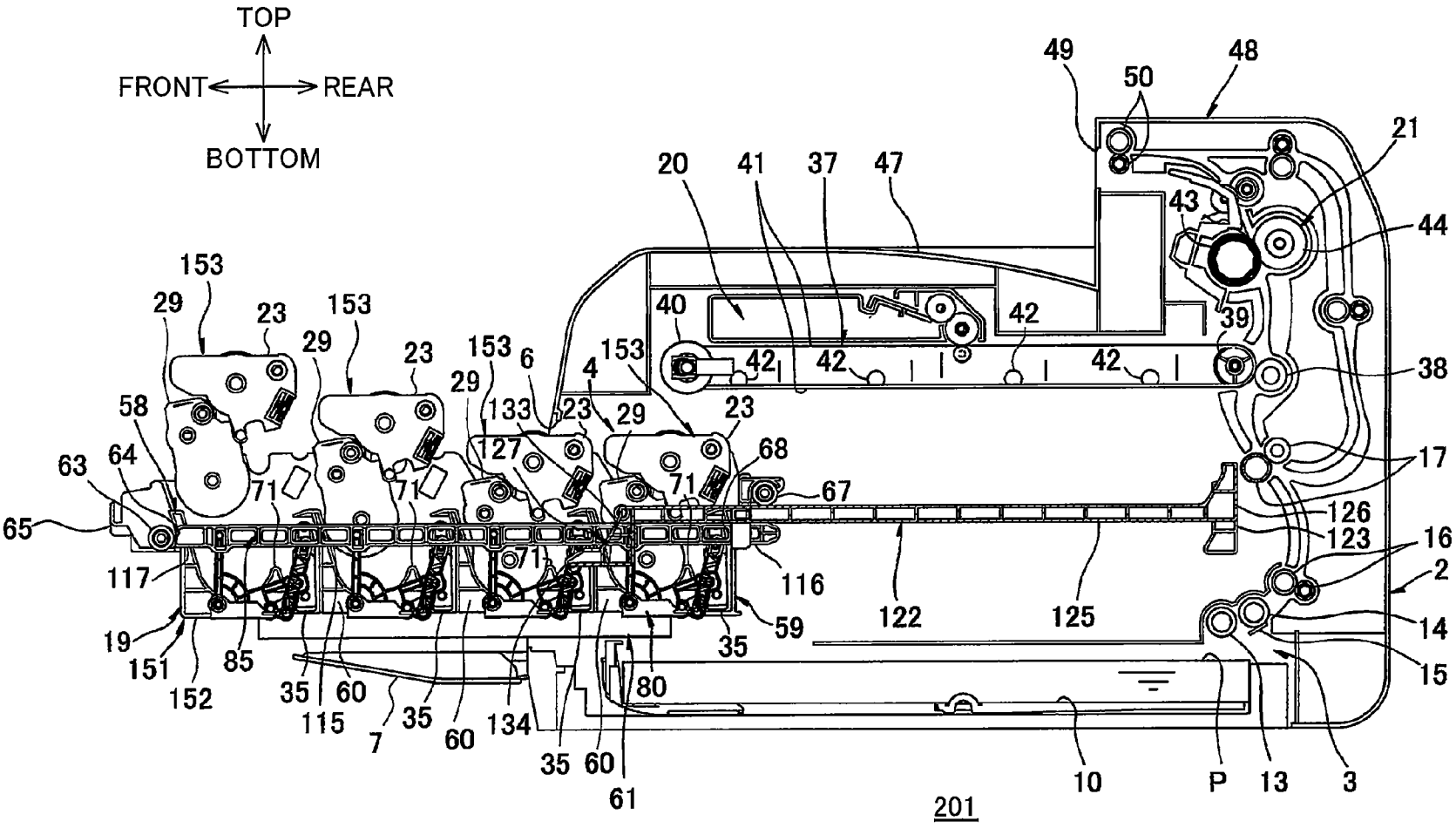
FIG. 9 is an explanatory view for explaining the interlocking motion of the LED units continued from FIG. 8B, in which the process drawer frame is disposed at an outside position.

When the process drawer frame 152 in which each LED unit 35 is disposed at the protected position is further withdrawn from the main casing 2, the process drawer frame 152 is disposed at the outside position as illustrated in FIG. 9.

Thereafter, each developing unit 29 is attached to or detached from the process drawer frame 152 disposed at the outside position, in the same manner as that of the first embodiment.

(2-2) Operation for Inserting Process Drawer Frame into Main Casing

Insertion of the process drawer frame 152 into the main casing 2 moves each of the plurality of LED units 35 from the protected position to the retracted position, and further insertion of the process drawer frame 152 into the main casing 2 moves the LED unit 35 from the retracted position to the exposing position.

In order to mount the process drawer frame 152 into the main casing 2, the operation described above for withdrawing the process drawer frame 152 from the main casing 2 is performed in reverse.

Specifically, when the process drawer frame 152 in which each LED unit 35 is disposed at the protected position is inserted into the main casing 2, each LED unit 35 is disposed at the retracted position as illustrated in FIG. 8A.

Then, when the process drawer frame 152 in which each LED unit 35 is disposed at the retracted position is further inserted into the main casing 2, each LED unit 35 is disposed at the exposing position as illustrated in FIG. 7

Then, the front cover 7 is pivotally moved to its closed position to cover the opening 6.

This completes the operation for mounting the process drawer frame 152 in the main casing 2.

(3) Operational Advantages of Second Embodiment

According to the second embodiment, even in a configuration in which the photosensitive drum 26 is provided in the process cartridge 153, the LED unit 35 can expose the photosensitive drum 26 when being disposed at the exposing position as illustrated in FIG. 7 and can be protected by the protection member 69 fixed to the process drawer frame 152 when being disposed at the protected position as illustrated in FIG. 8B.

As a result, each LED unit 35 can be protected reliably, and reliability of the printer 201 can be ensured over a prolonged period of time.

While the present invention has been described in detail with reference to the embodiments thereof, it would be apparent to those skilled in the art that various changes and modifications may be made therein without departing from the spirit of the present invention.

What is claimed is:

1. An image forming apparatus comprising:
a main casing;
a photosensitive member provided in the main casing;
a moving mechanism;
a movable member configured to move between an inside position in which the movable member is inside the main casing and an outside position in which the movable member is at least partly outside the main casing, the movable member comprising:
a frame;
a protection member fixed to the frame; and
an exposure member configured to expose the photosensitive member to light, the moving mechanism being configured to move the exposure member between an exposing position in which the exposure member exposes the photosensitive member to light and a protected position in which the exposure member is protected by the protection member; and
a cartridge including a developer bearing member, the cartridge being configured to be supported at the movable member,
wherein the moving mechanism is configured to move the exposure member to the exposing position, a retracted position in which the exposure member is moved from the exposing position in a direction away from the photosensitive member, and the protected position in which the exposure member is pivotally moved from the retracted position.

2. The image forming apparatus as claimed in claim 1, wherein the moving mechanism includes a link mechanism configured to move the exposure member to the exposing position, to the retracted position, and to the protected position.

3. The image forming apparatus as claimed in claim 2, wherein the link mechanism comprises:

a first link portion configured to move the exposure member between the exposing position and the retracted position; and a second link portion coupled to the first link portion and configured to move the exposure member between the retracted position and the protected position.

4. The image forming apparatus as claimed in claim 3, wherein the movable member is configured to move from a first position to a third position through a second position, the movable member at the first position being located at the inside position, the movable member at the third position being located at the outside position, the second position being located at the inside position and between the first position and the third position, wherein the link mechanism further comprises a third link portion coupled to the first link portion and configured to move relative to the movable member, the third link portion being configured to allow the first link portion to move the exposure member from the exposing position to the retracted position in response to the movement of the movable member from the first position toward the second position, the third link portion being further configured to allow the second link portion to move the exposure member from the retracted position to the protected position in response to the movement of the movable member from the second position toward the third position.

5. The image forming apparatus as claimed in claim 4, wherein the main casing includes an abutment wall configured to abut against the third link portion to allow the third link portion to move relative to the movable member.

6. The image forming apparatus as claimed in claim 1, wherein the exposure member includes an opposing portion opposing the photosensitive member when the exposure member is at the exposing position and opposing the protection member when the exposure member is at the protected position.

7. The image forming apparatus as claimed in claim 1, further comprising a belt configured to contact the photosensitive member and disposed above the photosensitive member when the movable member is located at the inside position.

8. The image forming apparatus as claimed in claim 1, wherein the photosensitive member includes a plurality of photosensitive bodies.

9. An image forming apparatus comprising:

a main casing;

a cartridge including a photosensitive member and a developer bearing member;

a moving mechanism; and a movable member configured to move between an inside position in which the movable member is inside the main casing and an outside position in which the movable member is at least partly outside the main casing, the cartridge being configured to be supported at the movable member, the movable member comprising:

a frame;

a protection member fixed to the frame; and an exposure member configured to expose the photosensitive member to light, the moving mechanism being configured to move the exposure member between an exposing position in which the exposure member exposes the photosensitive member to light and a protected position in which the exposure member is protected by the protection member, wherein the moving mechanism is configured to move the exposure member to the exposing position, a retracted position in which the exposure member is moved from the exposing position in a direction away from the photosensitive member, and the protected position in which the exposure member is pivotally moved from the retracted position.

10. The image forming apparatus as claimed in claim 9, wherein the moving mechanism includes a link mechanism configured to move the exposure member to the exposing position, to the retracted position, and to the protected position.

11. The image forming apparatus as claimed in claim 10, wherein the link mechanism comprises:

a first link portion configured to move the exposure member between the exposing position and the retracted position; and a second link portion coupled to the first link portion and configured to move the exposure member between the retracted position and the protected position.

12. The image forming apparatus as claimed in claim 11, wherein the movable member is configured to move from a first position to a third position through a second position, the movable member at the first position being located at the inside position, the movable member at the third position being located at the outside position, the second position being located at the inside position and between the first position and the third position, wherein the link mechanism further comprises a third link portion coupled to the first link portion and configured to move relative to the movable member, the third link portion being configured to allow the first link portion to move the exposure member from the exposing position to the retracted position in response to the movement of the movable member from the first position toward the second position, the third link portion being further configured to allow the second link portion to move the exposure member from the retracted position to the protected position in response to the movement of the movable member from the second position toward the third position.

13. The image forming apparatus as claimed in claim 12, wherein the main casing includes an abutment wall configured to abut against the third link portion to allow the third link portion to move relative to the movable member.

14. The image forming apparatus as claimed in claim 9, wherein the exposure member includes an opposing portion opposing the photosensitive member when the exposure member is at the exposing position and opposing the protection member when the exposure member is at the protected position.

15. The image forming apparatus as claimed in claim 9, further comprising a belt configured to contact the photosensitive member and disposed above the photosensitive member when the movable member is located at the inside position.

16. The image forming apparatus as claimed in claim 9, wherein the photosensitive member includes a plurality of photosensitive bodies.

* * * * *